US006552123B1

(12) United States Patent
Katayama et al.

(10) Patent No.: US 6,552,123 B1
(45) Date of Patent: Apr. 22, 2003

(54) THERMOPLASTIC POLYVINYL ALCOHOL FIBERS AND METHOD FOR PRODUCING THEM

(75) Inventors: Takashi Katayama, Kurashiki (JP); Kazuhiko Tanaka, Kurashiki (JP); Naoki Fujiwara, Kurashiki (JP); Tomoaki Kimura, Saijyo (JP); Akihiro Hokimoto, Kurashiki (JP); Nobuhiro Koga, Kurashiki (JP); Hitoshi Nakatsuka, Kurashiki (JP); Yoshimi Umemura, Kurashiki (JP); Hiroshi Kanehira, Kurashiki (JP); Masao Kawamoto, Kurashiki (JP); Junyo Nakagawa, Kurashiki (JP)

(73) Assignee: Kuraray Co., Ltd., Kurashiki (JP)

( * ) Notice: Subject to any disclaimer, the term of this patent is extended or adjusted under 35 U.S.C. 154(b) by 0 days.

(21) Appl. No.: 09/461,836

(22) Filed: Dec. 16, 1999

(51) Int. Cl.[7] ..... C08F 216/06; C08L 29/04

(52) U.S. Cl. ..... 525/57; 264/172.17; 264/176.1; 264/185; 264/211; 264/211.22; 264/331.1; 264/331.15; 264/210.8; 428/374; 428/394; 428/364; 428/369; 428/373; 428/401; 428/457; 428/500; 524/377; 524/503; 525/56; 525/58; 525/60; 525/61; 525/62

(58) Field of Search ..... 525/61, 56, 57, 525/58, 62, 60; 524/503, 377; 264/172.17, 176.1, 185, 210.8, 211, 211.22, 331.1, 331.15; 428/364, 369, 401, 457, 373, 500, 374, 394; 57/243, 244

(56) References Cited

U.S. PATENT DOCUMENTS 4,172,930 A * 10/1979 Kajitani et al. ..... 524/56

* cited by examiner

*Primary Examiner*—Judy M. Reddick
(74) *Attorney, Agent, or Firm*—Oblon, Spivak, McClelland, Maier & Neustadt, P.C.

(57) ABSTRACT

Provided are melt-spun fibers comprising, as at least one component, a water-soluble polyvinyl alcohol, and a method for producing fibrous structures comprising the fibers. The thermoplastic polyvinyl alcohol fibers comprise, as at least one component, a water-soluble polyvinyl alcohol containing from 0.1 to 25 mol % of C1–4 α-olefin units and/or vinyl ether units, having a molar fraction, based on vinyl alcohol units, of a hydroxyl group of vinyl alcohol unit located at the center of 3 successive vinyl alcohol unit chain in terms of triad expression of being from 70 to 99.9 mol %, having a carboxylic acid and lactone ring content of from 0.02 to 0.15 mol %, and having a melting point falling between 160° C. and 230° C., and contain from 0.0003 to 1 part by weight, relative to 100 parts by weight of the polyvinyl alcohol therein and in terms of sodium ion, of an alkali metal ion.

22 Claims, No Drawings

THERMOPLASTIC POLYVINYL ALCOHOL FIBERS AND METHOD FOR PRODUCING THEM

BACKGROUND OF THE INVENTION

1. Field of the Invention

The present invention relates to fibers comprising, as at least one component, a thermoplastic polyvinyl alcohol with good solubility in water, and to a melt-spinning method for them. The invention also relates to fibrous structures such as yarns, woven fabrics, knitted fabrics and others comprising the fibers, and to fibrous products as obtained by processing the fibrous structures with water. The invention further relates to non-woven fabrics comprising a thermoplastic polyvinyl alcohol with good solubility or good flushability (disintegratability into fibers) in water.

2. Description of the Related Art

Water-soluble fibers comprising polyvinyl alcohol (PVA) are known, which are produced, for example, 1) in a wet-spinning or dry-jet-wet-spinning method in which both the dope solvent and the solidifying medium are of aqueous systems; 2) a dry-spinning method in which the dope solvent is of an aqueous system; and 3) a wet-spinning or dry-jet-wet-spinning (that is, gel-spinning) method in which both the dope solvent and the solidifying medium are of non-aqueous solvent systems.

These water-soluble PVA fibers are used as staple or short-cut fibers for dry non-woven and spun yarns and also in the field of papermaking, etc., or are used as multi-filaments for woven fabrics and knitted fabrics. Of those, in particular, short-cut fibers soluble in hot water at 80 to 90° C. hold an important place in the papermaking industry, serving as a fibrous binder therein; and multi-filaments are much used as the base fabric for chemical lace. To solve the recent problems with the environment, they are specifically noticed as biodegradable fibers favorable to the ecology.

However, in the conventional spinning methods mentioned above, high-speed spinning, for example, at a rate over 500 m/min is difficult, complicatedly modified cross-section fibers having a high degree of cross-section modification are difficult to produce, and specific equipment for recovering various solvents used in the spinning step is needed. Therefore, as compared with a melt-spinning method, the conventional spinning methods are much restrained in various aspects and therefore inevitably require specific care.

In ordinary spinning technology of removing the solvent from the substance having been spun out through a spinning nozzle to give fibers, the surface of each fiber obtained is seen to have fine hillocks and recesses such as longitudinal streaks or the like running thereon in the direction of the fiber axis, when magnified to the size of 2000 times or more. Such fine hillocks and recesses formed on the fiber surface will induce fibrillation, when rubbed against the guide and others in the subsequent steps after the spinning step, thereby causing one reason for failed appearance and even end breakage of spun fibers.

Some examples of producing PVA fibers through melt-spinning are known. For example, in Japanese Patent Laid-Open No. 152062/1975, proposed is a technique of producing crapy woven fabrics, which comprises melt-spinning PVA copolymerized with a minor olefin to be a sheath component and a hydrophobic polymer substance to be a core component in a bi-component fiber spinning manner to give core/sheath bi-component fibers, weaving the resulting fibers into a fabric, and processing the fabric in an aqueous solution to dissolve and remove the PVA copolymer component of the bi-component fibers constituting the fabric. In Japanese Patent Laid-Open No. 152063/1975, another technique of producing crapy woven fabric is proposed. In this, core/sheath bi-component fibers composed of a mixture of PVA and a plasticizer serving as the sheath component and a hydrophobic polymer substance serving as the core component are woven into a fabric, and the fabric is processed in an aqueous solution to dissolve and remove the sheath component of the fibers constituting the fabric. In Japanese Patent Laid-Open No. 105122/1988, proposed are bi-component fibers comprising a modified PVA as one component. In this, the modified PVA is dissolved and removed in the step of post-processing the fibers.

However, the prior art techniques noted above are still problematic in that the solubility of PVA in water is poor and the fibers being spun are often broken. It has heretofore been impossible to produce PVA fibers satisfying both the requirements of good solubility in water and good spinning process stability. On the other hand, in the technique of completely removing water-soluble fibers, for example, for producing chemical lace or spun yarn with hollow structure, single-component fibers of PVA alone but not bi-component fibers are used. For bi-component fibers comprising PVA, even when the fiber-forming capability of the water-soluble PVA used as one component is not good, spinning them is possible so far as the other polymer to be combined with PVA has the capability of forming fibers. However, for single-component fibers of PVA alone, PVA must have good capability of forming fibers by itself. Therefore, the problem in fiber spinning is that planning polymer constitution and settling spinning conditions are more difficult in single-component fiber spinning than in bi-component fiber spinning.

Non-woven fabric structures are often used for disposable fiber products, and non-woven fabrics comprising PVA fibers have been proposed for them. In some applications, those not completely soluble in water but capable of losing their non-woven texture to be disposable are used. However, for most non-woven fabrics of water-soluble PVA that have heretofore been proposed, PVA fibers are produced in a wet or dry-jet-wet spinning method. In Japanese Patent Laid-Open No. 345013/1993, partially proposed is a melt-spinning method for non-woven PVA fabrics. However, this has no concrete description of the method, and, needless-to-say, does neither disclose nor suggest what type of PVA shall be used for satisfying all the requirements of spinning process stability and solubility or flushability in water.

SUMMARY OF THE INVENTION

The present invention is to solve the problems with the conventional water-soluble PVA fibers noted above for their process stability and solubility in water, and its one object is to provide a stable melt-spinning method for fibers comprising a water-soluble polyvinyl alcohol as at least one component. Being different from the conventional wet-spinning, dry-jet-wet-spinning, dry-spinning and solvent-spinning methods noted above, the method provided herein is free from productivity limitation and cross-section profile limitation of the fibers produced, and does not require any specific equipment for product recovery.

Another object of the invention is to provide non-woven PVA fabrics with good solubility or good flushability (disintegratability into fibers) in water for which the PVA fibers are produced in a stable melt-spinning method but not in the conventional wet-spinning, dry-jet-wet-spinning, dry-spinning or solvent-spinning method.

Specifically, the invention provides thermoplastic polyvinyl alcohol fibers which comprise, as at least one component, a water-soluble polyvinyl alcohol containing from 0.1 to 25 mol % of C1–4 α-olefin units and/or vinyl ether units, having a molar fraction, based on vinyl alcohol units, of a hydroxyl group of vinyl alcohol unit located at the center of 3 successive vinyl alcohol unit chain in terms of triad expression of being from 70 to 99.9 mol %, having a carboxylic acid and lactone ring content of from 0.02 to 0.15 mol %, and having a melting point(Tm) falling between 160° C. and 230° C., and which contain an alkali metal ion in an amount in terms of sodium ion of 0.0003 to 1 part by weight based on 100 parts by weight of the polyvinyl alcohol.

The invention also provides a method for producing thermoplastic polyvinyl alcohol fibers, which comprises melt-spinning the polyvinyl alcohol noted above at a spinneret temperature falling between melting point(Tm) and Tm+80° C., at a shear rate (γ) of from 1,000 to 25,000 $sec^{-1}$, and at a draft of from 10 to 500.

The invention further provides a method for producing fibrous products, which comprises processing fibrous structures that contain, as at least one component, the thermoplastic polyvinyl alcohol fibers noted above with water to thereby dissolve and remove the polyvinyl alcohol.

The invention still further provides a non-woven fabric which is composed of fibers comprising, as at least one component, a modified polyvinyl alcohol containing from 0.1 to 25 mol % of C1–4 α-olefin units and/or vinyl ether units, having a molar fraction, based on vinyl alcohol units, of a hydroxyl group of vinyl alcohol unit located at the center of 3 successive vinyl alcohol unit chain in terms of triad expression of being from 66 to 99.9 mol %, having a carboxylic acid and lactone ring content of from 0.02 to 0.15 mol %, and having a melting point falling between 160° C. and 230° C., and which contains an alkali metal ion in an amount in terms of sodium ion of 0.0003 to 1 part by weight based on 100 parts by weight of the polyvinyl alcohol.

DETAILED DESCRIPTION OF THE INVENTION

Polyvinyl alcohol for use in the invention is a modified polyvinyl alcohol with functional groups introduced thereinto through copolymerization, terminal modification and/or post-reaction, and it contains a specific amount of carboxylic acid and lactone ring moieties.

Methods for producing PVA with carboxylic acid and lactone ring moieties therein include, for example, the following:

① A method of saponifying a vinyl ester polymer as obtained by copolymerizing a vinyl ester monomer such as vinyl acetate or the like with a monomer having the ability to form a carboxylic acid and a lactone ring, in an alcohol or dimethylsulfoxide solution.

② A method of polymerizing a vinyl ester monomer in the presence of a carboxylic acid-having thiol compound such as mercaptoacetic acid, 3-mercaptopropionic acid or the like, followed by saponifying the resulting polymer.

③ A method of polymerizing a vinyl ester monomer such as vinyl acetate or the like along with chain transfer reaction on the alkyl group in the vinyl ester monomer and in the resulting vinyl ester polymer to give a high-branched vinyl ester polymer, followed by saponifying the polymer.

④ A method of reacting a copolymer of an epoxy group-having monomer and a vinyl ester monomer, with a carboxyl group-having thiol compound, followed by saponifying the resulting reaction product.

⑤ A method of acetalyzing PVA with a carboxyl group-having aldehyde.

The vinyl ester monomer includes, for example, vinyl formate, vinyl acetate, vinyl propionate, vinyl valerate, vinyl caprate, vinyl laurate, vinyl stearate, vinyl benzoate, vinyl pivalate, vinyl versatate, etc. Of those, preferred is vinyl acetate for producing PVA.

The monomer having the ability to produce a carboxylic acid and a lactone ring includes, for example, monomers having a carboxyl group derived from fumaric acid, maleic acid, itaconic acid, maleic anhydride, itaconic anhydride, etc.; acrylic acid and its salts; acrylates such as methyl acrylate, ethyl acrylate, n-propyl acrylate, i-propyl acrylate, etc.; methacrylic acid and its salts; methacrylates such as methyl methacrylate, ethyl methacrylate, n-propyl methacrylate, i-propyl methacrylate, etc.; acrylamide and its derivatives such as N-methylacrylamide, N-ethylacrylamide, etc.; methacrylamide and its derivatives such as N-methylmethacrylamide, N-ethylmethacrylamide, etc.

The comonomers that may be introduced into PVA in the invention include, for example, α-olefins such as ethylene, propylene, 1-butene, isobutene, 1-hexene, etc.; acrylic acid and its salts; acrylates such as methyl acrylate, ethyl acrylate, n-propyl acrylate, i-propyl acrylate, etc.; methacrylic acid and its salts; methacrylates such as methyl methacrylate, ethyl methacrylate, n-propyl methacrylate, i-propyl methacrylate, etc.; acrylamide and its derivatives such as N-methylacrylamide, N-ethylacrylamide, etc.; methacrylamide and its derivatives such as N-methylmethacrylamide, N-ethylmethacrylamide, etc.; vinyl ethers such as methyl vinyl ether, ethyl vinyl ether, n-propyl vinyl ether, i-propyl vinyl ether, n-butyl vinyl ether, etc.; hydroxyl group-having vinyl ethers such as ethylene glycol vinyl ether, 1,3-propanediol vinyl ether, 1,4-butanediol vinyl ether, etc.; allyl acetate; allyl ethers such as propyl allyl ether, butyl allyl ether, hexyl allyl ether, etc.; oxyalkylene group-having monomers; vinylsilyls such as vinyltrimethoxysilane, etc.; hydroxyl group-having α-olefins such as isopropenyl acetate, 3-buten-1-ol, 4-penten-1-ol, 5-hexen-1-ol, 7-octen-1-ol, 9-decen-1-ol, 3-methyl-3-buten-1-ol, etc.;monomers having a carboxyl group derived from fumaric acid, maleic acid, itaconic acid, maleic anhydride, phthalic anhydride, trimellitic anhydride, itaconic anhydride, etc.; monomers having a sulfonic acid group derived from ethylenesulfonic acid, allylsulfonic acid, methallylsulfonic acid, 2-acrylamido-2-methylpropanesulfonic acid, etc.; monomers having a cationic group derived from vinyloxyethyltrimethylammonium chloride, vinyloxybutyltrimethylammonium chloride, vinyloxyethyldimethylamine, vinyloxymethyldiethylamine, N-acrylamidomethyltrimethylammonium chloride, N-acrylamidoethyltrimethylammonium chloride, N-acrylamidodimethylamine, allyltrimethylammonium chloride, methallyltrimethylammonium chloride, dimethylallylamine, allylethylamine, etc. The monomer content of PVA is at most 25 mol %.

Of those monomers, preferred are α-olefins such as ethylene, propylene, 1-butene, isobutene, 1-hexene, etc.; vinyl ethers such a methyl vinyl ether, ethyl vinyl ether, n-propyl vinyl ether, i-propyl vinyl ether, n-butyl vinyl ether, etc.; hydroxyl group-having vinyl ethers such as ethylene glycol vinyl ether, 1,3-propanediol vinyl ether, 1,4-butanediol vinyl ether, etc.; allyl acetate; allyl ethers such as propyl allyl ether, butyl allyl ether, hexyl allyl ether, etc.; oxyalkylene group-having monomers; hydroxyl group-having α-olefins such as 3-buten-1-ol, 4-penten-1-ol, 5-hexen-1-ol, 7-octen-1-ol, 9-decen-1-ol, 3-methyl-3-buten-1-ol, etc., as they are easily available.

More preferred are C1–4 α-olefins such as ethylene, propylene, 1-butene, isobutene, etc.; vinyl ethers such as methyl vinyl ether, ethyl vinyl ether, n-propyl vinyl ether, i-propyl vinyl ether, n-butyl vinyl ether, etc., in view of their copolymerizability, of the melt-spinnability of PVA modified with them, and of the solubility in water of the PVA fibers. PVA contains from 0.1 to 25 mol %, but preferably from 4 to 15 mol %, more preferably from 6 to 13 mol % of the units derived from C1–4 α-olefins and/or vinyl ethers.

Ethylene is preferred as the α-olefin, as improving the physical properties of the PVA fibers. Therefore, it is especially preferable to use a modified PVA with from 4 to 15 mol %, more preferably from 6 to 13 mol % of ethylene units introduced therein.

PVA for use in the invention may be prepared in any known method of bulk polymerization, solution polymerization, suspension polymerization, emulsion polymerization or the like. Of those, generally employed is a bulk polymerization method or a solution polymerization method in which the monomers are polymerized in the absence of a solvent or in the presence of a solvent such as alcohol or the like. The alcohol used as the solvent for solution polymerization includes, for example, lower alcohols such as methyl alcohol, ethyl alcohol, propyl alcohol, etc. The initiator to be used for copolymerization may be any known one, including, for example, azo-type initiators and peroxide-type initiators such as α, α-azobisisobutyronitrile, 2,2'-azobis(2,4-dimethyl-valeronitrile), benzoyl peroxide, n-propyl peroxycarbonate, etc. The polymerization temperature may fall between 0° C. and 150° C. For PVA desired to be soluble in water at lower temperatures, the polymerization temperature is preferably not lower than 40° C., more preferably not lower than 50° C. However, if the polymerization temperature is too high, the degree of polymerization of PVA produced will be too low. Therefore, it is desirable that the polymerization temperature is not higher than 130° C., more preferably not higher than 120° C.

The molar fraction, based on vinyl alcohol units, of a hydroxyl group of vinyl alcohol unit located at the center of 3 successive vinyl alcohol unit chain in terms of triad expression as referred to herein is meant to indicate the peak (I) for PVA as measured in d6-DMSO at 65° C. with a 500 MHz proton NMR (JEOL GX-500 Model), which reflects the triad tacticity of the hydroxyl protons in PVA.

The peak (I) indicates the total sum of the hydroxyl groups in the vinyl alcohol units in PVA, appearing for the isotacticity chain (4.54 ppm), the heterotacticity chain (4.36 ppm) and the syndiotacticity chain (4.13 ppm) in triad expression; and the peak (II) appearing for all hydroxyl groups in the vinyl alcohol units in PVA is within the chemical shift region falling between 4.05 ppm and 4.70 ppm. Therefore, in the invention, the molar fraction, based on vinyl alcohol units, of a hydroxyl group of vinyl alcohol unit located at the center of 3 successive vinyl alcohol unit chain in terms of triad expression is represented by: 100×(I)/(II).

In the invention, the molar fraction, based on vinyl alcohol units, of a hydroxyl group of vinyl alcohol unit located at the center of 3 successive vinyl alcohol unit chain in terms of triad expression is controlled in the manner as specifically defined herein, whereby the water-related properties including solubility in water and water absorbability of PVA, the mechanical properties including strength, elongation and modulus of PVA fibers, and also the melt-spinning-related properties including melting point and melt viscosity of PVA are well controlled enough to meet the object of the invention. This is because a hydroxyl group of vinyl alcohol unit located at the center of 3 successive vinyl alcohol unit chain in terms of triad expression is rich in crystallinity and could well exhibit the characteristics of PVA.

In the present invention, except for non-woven fabrics, the molar fraction, based on vinyl alcohol units, of a hydroxyl group of vinyl alcohol unit located at the center of 3 successive vinyl alcohol unit chain in terms of triad expression falls between 70 and 99.9 mol %, but preferably between 72 and 99 mol %, more preferably between 74 and 97 mol %, even more preferably between 75 and 96 mol %, further preferably between 76 and 95 mol %. In non-woven fabrics, PVA may not be completely dissolved for some applications so far as the fabrics can be disintegrated into fibers. In those, therefore, the molar fraction, based on vinyl alcohol units, of a hydroxyl group of vinyl alcohol unit located at the center of 3 successive vinyl alcohol unit chain in terms of triad expression may fall between 66 and 99.9 mol %, but preferably between 70 and 99 mol %, more preferably between 74 and 97 mol %, even more preferably between 75 and 96 mol %, further preferably between 76 and 95 mol %.

If the molar fraction, based on vinyl alcohol units, of a hydroxyl group of vinyl alcohol unit located at the center of 3 successive vinyl alcohol unit chain in terms of triad expression is lower than the defined lowermost limit, the crystallinity of the polymer PVA is low. If so, the strength of the PVA fibers will be low, and, in addition, while the fibers are melt-spun, they will be glued together and the wound fibers could not be unwound. What is more, thermoplastic fibers having good solubility in water and also non-woven fabrics having good flushability, which the invention is intended to obtain, could not be obtained.

On the other hand, if the molar fraction, based on vinyl alcohol units, of a hydroxyl group of vinyl alcohol unit located at the center of 3 successive vinyl alcohol unit chain in terms of triad expression is higher than 99.9 mol %, the melt-spinning temperature for the polymer PVA must be high since the melting point of the polymer is high. If so, the polymer being melt-spun will be decomposed, gelled or colored, as its heat stability is not good.

Where PVA for use in the invention is an ethylene-modified PVA, the PVA preferably satisfies the following formula, as producing better results.

$$-1.5\times Et+100>\text{molar fraction}\geqq -Et+85$$

wherein the molar fraction indicates the molar fraction, based on vinyl alcohol units, of a hydroxyl group of vinyl alcohol unit located at the center of 3 successive vinyl alcohol unit chain in terms of triad expression; and Et indicates the ethylene content (unit: mol %) of the PVA.

The carboxylic acid and lactone ring content of PVA for use in the invention falls between 0.02 and 0.15 mol %, but preferably between 0.022 and 0.145 mol %, more preferably between 0.024 and 0.13 mol %, even more preferably between 0.025 and 0.13 mol %. The carboxylic acid in the invention includes its alkali metal salts, and the alkali metal includes potassium, sodium, etc.

If the carboxylic acid and lactone ring content of PVA is smaller than 0.02 mol %, PVA greatly gels while it is melt-spun, and its melt-spinnability is poor. If so, in addition, the solubility in water of PVA is low. On the other hand, if the carboxylic acid and lactone ring content of PVA is larger than 0.15 mol %, the heat stability of PVA is poor. If so, PVA pyrolyzes and gels, and therefore could not be spun in melt.

The carboxylic acid and lactone ring content of PVA can be obtained from the peak appearing in proton NMR of PVA. Briefly, PVA is completely saponified to have a degree of saponification of at least 99.95 mol %, then fully washed with methanol, and thereafter dried in vacuum at 90° C. for 2 days to prepare a sample of PVA to be analyzed through proton NMR.

Concretely, in the method ① mentioned above, the PVA sample prepared is dissolved in DMSO-D6, and subjected to 500 MHz proton NMR (with JEOL GX-500) at 60° C. The content of the monomers of acrylic acid, acrylates, acrylamide and acrylamide derivatives constituting the polymer PVA is calculated in an ordinary manner from the peak (2.0 ppm) derived from the main chain methine of the polymer; and that of the monomers of methacrylic acid, methacrylates, methacrylamide and methacrylamide derivatives constituting it is from the peaks (0.6 to 1.1 ppm) derived from the methyl groups directly bonding to the main chain of the polymer. To measure the content of the monomers having a carboxyl group derived from fumaric acid, maleic acid, itaconic acid, maleic anhydride, itaconic anhydride or the like, the PVA sample prepared is dissolved in DMSO-D6, to which is added a few drops of trifluoroacetic acid, and the resulting PVA solution is subjected to 500 MHz proton NMR (with JEOL GX-500) at 60° C. The monomer content is calculated in an ordinary manner, based on the methine peak for the lactone ring assigned to the region between 4.6 and 5.2 ppm.

For PVA prepared in the methods ② and ④, the monomer content is calculated, based on the peak (2.8 ppm) derived from the methylene directly bonding to the sulfur atom.

In the method ①, the PVA sample prepared is dissolved in methanol-D4/$D_2O$=2/8, and the resulting solution is subjected to 500 MHz proton NMR (with JEOL GX-500) at 80° C. The methylene-derived peaks for the terminal carboxylic acid or its alkali metal salt (see the following structural formula 1 and structural formula 2) are assigned to 2.2 ppm (integrated value A) and to 2.3 ppm (integrated value B); the methylene-derived peak for the terminal lactone ring (see the following structural formula 3) is to 2.6 ppm (integrated value C); and the methine-derived peaks for the vinyl alcohol units are to the region falling between 3.5 and 4.15 ppm (integrated value D). The carboxylic acid and lactone ring content of PVA is calculated, as in the following formula in which Δ indicates the degree of modification (mol %).

$$\text{Carboxylic acid and lactone content (mol \%)}=50\times(A+B+C)\times\{(100-\Delta)/(100\times D)\}\times 100 \quad (3).$$

(Na)HOOCC$\underline{H}_2$CH$_2$CH$_2$~ Structural Formula 1:

NaOOCC$\underline{H}_2$CH$_2$CH(OH)~ Structural Formula 2:

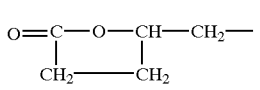

In the method ②, the PVA sample prepared is dissolved in DMSO-D6, and the resulting solution is subjected to 500 MHz proton NMR (with JEOL GX-500) at 60° C. Based on the peaks derived from the methine group in the acetal moieties and appearing within the region between 4.8 and 5.2 ppm (see the following structural formula 4), the monomer content is calculated in an ordinary manner.

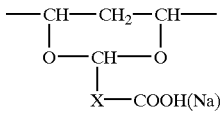

wherein X indicates single bond or an alkyl group having from 1 to 10 carbon atoms.

PVA for use in the invention has a melting point(Tm) falling between 160 and 230° C., preferably between 170 and 227° C., more preferably between 175 and 224° C., even more preferably between 180 and 220° C. PVA having a melting point of lower than 160° C. has poor crystallinity, and the strength of its fibers is poor. As the case may be, in addition, it could not form fibers as its heat stability is poor. What is more, when the PVA fibers are melt-blown, the resulting web will have many resin beads(shot) and could not keep its properties, or, as the case may be, they could not form web.

On the other hand, PVA having a melting point of higher than 230° C. must be melt-spun at high temperatures. That is, the melt-spinning temperature for it will be near to its decomposition point. As a result, stably processing it to form fibers or to form non-woven fabrics in melt-blowing will be impossible.

The melting point of PVA may be measured through DSC (with Mettler's TA3000). Briefly, using the DSC device, a sample of PVA to be measured is heated up to 250° C. in nitrogen at a heating rate of 10° C./min, then cooled to room temperature, and again heated up to 250° C. at a heating rate of 10° C./min. The top of the endothermic peak appearing in the heat cycle is read, and this indicates the melting point of the PVA.

The alkali metal ion content of PVA for use in the invention falls between 0.0003 and 1 part by weight in terms of sodium ion and relative to 100 parts by weight of PVA, but preferably between 0.0003 and 0.8 parts by weight, more preferably between 0.0005 and 0.6 parts by weight, even more preferably between 0.0005 and 0.5 parts by weight. If the alkali metal ion content of PVA is smaller than 0.0003 parts by weight, the PVA fibers are not sufficiently soluble in water. If so, the PVA fibers will give some insoluble in water. If, on the other hand, the alkali metal ion content of PVA is larger than 1 part by weight, PVA decomposes and gels too much while it is melt-spun, and could not form fibers.

The alkali metal ion includes, for example, ions of potassium, sodium, etc.

In the invention, the specific amount of an alkali metal ion is incorporated into PVA, for which the method is not specifically defined. For example, employable is a method of adding an alkali metal ion-having compound to PVA having been prepared through polymerization; or a method of saponifying a vinyl ester polymer in a solvent, in which an alkali metal ion-having, alkaline substance is used as the catalyst for saponification to thereby introduce the alkali metal ion into PVA, and the thus-saponified PVA is washed with a washing liquid so as to control the alkali metal ion content of the PVA. The latter is preferred.

The alkali metal ion content of PVA can be measured through atomic absorptiometry.

The alkaline substance to be used as the catalyst for saponification includes, for example, potassium hydroxide and sodium hydroxide. The molar ratio of the alkaline substance to be used as the catalyst for saponification to the vinyl acetate units in the polymer to be saponified preferably falls between 0.004 and 0.5, more preferably between 0.005 and 0.05. The catalyst for saponification may be added all at a time in the initial stage of saponification, or may be intermittently added in the course of saponification.

The solvent for saponification includes, for example, methanol, methyl acetate, diethyl sulfoxide, dimethylformamide, etc. Of those solvents, preferred is methanol; more preferred is methanol having a controlled water content of from 0.001 to 1% by weight; even more preferred is methanol having a controlled water content of from 0.003 to 0.9% by weight; and still more preferred is methanol having a controlled water content of from 0.005 to 0.8% by weight. The washing liquid includes, for example, methanol, acetone, methyl acetate, ethyl acetates, hexane, water, etc. Of those, preferred are methanol, methyl acetate and water, which may be used either singly or as combined.

The amount of the washing liquid is so controlled that the alkali metal ion content of PVA could fall within the defined range, but, in general, it falls preferably between 300 and 10000 parts by weight, more preferably between 500 and 5000 parts by weight, relative to 100 parts by weight of PVA. The washing temperature preferably falls between 5 and 80° C., more preferably between 20 and 70° C. The washing time preferably falls between 20 minutes and 10 hours, more preferably between 1 hour and 6 hours.

Preferably, the viscosity-average degree of polymerization (hereinafter simply referred to as the degree of polymerization) of PVA to be produced in the manner noted above falls between 200 and 500, more preferably between 230 and 470, even more preferably between 250 and 450. PVA having a degree of polymerization of smaller than 200 causes poor melt-spinnability, and it will often fail to form fibers. On the other hand, PVA having a degree of polymerization of larger than 500 will often fail to pass through a spinning nozzle, as its melt viscosity is too high. What is more, if PVA having such a high degree of polymerization is formed into a melt-blown non-woven fabric, the mean diameter of the fibers constituting the non-woven fabric will be large and the fibers will be partially coiled or rounded to form aggregates in the fabric. The non-woven fabric thus having such fiber aggregates will have a rough feel, and will often lose the characteristics intrinsic to melt-blown non-woven fabrics.

So-called low-polymerization PVA having a low degree of polymerization rapidly dissolve in an aqueous solution, and, in addition, the fibers comprising the PVA of that type will shrink to a reduced degree when they are processed in an aqueous solution to dissolve the PVA component therein.

The degree of polymerization (P) of PVA can be measured according to JIS-K6726. Briefly, PVA is re-saponified and then purified, and its limiting viscosity [η] in water at 30° C. is measured, from which the degree of polymerization, P, of PVA is obtained as in the following equation:

$$P=([\eta]\times 10^3/8.29)^{(1/0.62)}.$$

PVA of which the degree of polymerization falls within the defined range as above produces better results.

Preferably, the degree of saponification of PVA falls between 90 and 99.99 mol %, preferably between 93 and 99.98 mol %, more preferably between 94 and 99.97 mol %, even more preferably between 96 and 99.96 mol %. PVA having a degree of saponification of smaller than 90 mol % could not be melt-spun in a satisfactory manner, as its heat stability is poor and it often pyrolyzes or gels. In addition, depending on the type of the comonomers constituting it, PVA having such a low degree of saponification will be poorly soluble in water and often could not attain the object of the invention.

On the other hand, it is impossible to stably produce PVA having a degree of saponification of larger than 99.99 mol %, and, even if produced, PVA of that type often fails to form stable fibers.

So far as they do not interfere with the object and the effect of the invention, various additives may be added to PVA in the course of polymerization to prepare PVA or during post-treatment of the polymer PVA. The optional additives include, for example, stabilizers such as copper compounds, etc., as well as colorants, UV absorbents, light stabilizers, antioxidants, antistatic agents, flame retardants, plasticizers, lubricants, crystallization retardants, etc. Adding heat stabilizers to PVA is preferred, as they improve the melt residence stability of PVA being formed into fibers. Preferred heat stabilizers include organic stabilizers such as hindered phenols, etc.; copper halides such as copper iodide, etc.; alkali metal halides such as potassium iodide, etc.

Also if desired, fine particles having a mean particle size of from 0.01 μm to 5 μm may be added to PVA, in an amount of from 0.05% by weight to 10% by weight, in the course of polymerization to prepare PVA or during post-treatment of the polymer PVA. The type of the fine particles is not specifically defined. For example, inert fine particles of silica, alumina, titanium oxide, calcium carbonate, barium sulfate or the like may be added thereto, either singly or as combined. Especially preferred are inorganic fine particles having a mean particle size of from 0.02 μm to 1 μm, as improving the spinnability and drawability of PVA.

The thermoplastic polyvinyl alcohol fibers of the invention include not only fibers of PVA alone but also multi-component spun fibers such as conjugate fibers and mixed spun fibers comprising PVA as one component, and some other thermoplastic polymers having a melting point of not higher than 270° C. The combination pattern of each component in cross-section of multi-component fibers is not specifically defined, including, for example, core/sheath fibers, island/sea fibers, side-by-side fibers, multi-layered fibers, radial division fibers, and their combinations. For example, in bi-component fibers composed of PVA serving as the sea component and a different thermoplastic polymer serving as the island component, the sea component PVA may be removed to give ultra-fine fibers. In bi-component fibers composed of PVA serving as the core component and a different thermoplastic polymer serving as the sheath component, the core component PVA may be removed to give hollow fibers. A fabric of bi-component fibers composed of PVA serving as the sheath component and a different thermoplastic polymer serving as the core component may be processed with water to remove the sheath component PVA. After having been thus processed, the fabric could have an improved feel. On the other hand, the fabric of bi-component fibers of that type may be processed in a different manner of positively leaving the sheath component only as it is, and the remaining fibers could be useful as binder fibers.

In multi-component fibers, the polymers to be combined with PVA are preferably thermoplastic fibers having a melting point of not higher than 270° C. For example, they include aromatic polyesters such as polyethylene terephthalate, polybutylene terephthalate, polyhexamethylene terephthalate, etc., and their copolymers; aliphatic polyesters and their copolymers such as polylactic acid, polyethylene succinate, polybutylene succinate, polybutylene succinate adipate, polyhydroxybutyrate-polyhydroxyvalerate copolymers, polycaprolactone, etc.; aliphatic polyamides and their copolymers such as nylon 6, nylon 66, nylon 10, nylon 12, nylon 6–12, etc.; polyolefins such as polypropylene, polyethylene, polymethylpentene, etc., and their copolymers; modified polyvinyl alcohol having from 25 mol % to 70 mol % of ethylene units; as well as polystyrene elastomers, polydiene elastomers, chlorine-containing elastomers, polyolefin elastomers, polyester elastomers, polyurethane elastomers, polyamide elastomers, etc. At least one of these polymers may be combined with PVA to give multi-component fibers.

Of those, preferred are polybutylene terephthalate, ethylene terephthalate copolymers, polylactic acid, nylon 6, nylon 6–12, polypropylene, and modified polyvinyl alcohol having from 25 mol % to 70 molt of ethylene units, as being readily multi-spun with PVA for use in the invention.

For the polyester copolymers usable herein, the comonomers include, for example, aromatic dicarboxylic acids such as isophthalic acid, naphthalene-2,6-dicarboxylic acid, phthalic acid, α,β-(4-carboxyphenoxy)ethane, 4,4'-dicarboxydiphenyl, 5-sodium sulfoisophthalate, etc.; aliphatic dicarboxylic acids such as adipic acid, sebacic acid, etc.; and diol compounds such as diethylene glycol, 1,4-butanediol, 1,6-hexanediol, neopentyl glycol, cyclohexane-1,4-dimethanol, polyethylene glycol, polytrimethylene glycol, polypropylene glycol, polytetramethylene glycol, etc. The proportion of the comonomers in copolymerization is preferably at most 80 mol %.

Where multi-component fibers comprising, as one component, an aliphatic polyester such as polylactic acid or the like are processed to remove the other component from them, thereby producing aliphatic polyester fibers, the aliphatic polyester fibers produced will be degraded or decomposed if the other component is removed through extraction with some chemicals except water. Therefore, in producing the multi-component fibers comprising such as polyester as one component, it is effective to use, as the other component, PVA shown herein for the present invention.

In producing bi-component fibers in the invention, it is preferable to use an aliphatic polyester such as polylactic acid or the like as the thermoplastic polymer having a melting point of not higher than 270° C., since polylactic acid is biodegradable by itself and since the polyvinyl alcohol component having been removed from the fibers through extraction with water to be in an aqueous solution thereof is also biodegradable. As a whole, therefore, the bi-component fibers of that type are biodegradable.

In any mode of single-component spinning or multi-component spinning for producing the fibers of the invention, employable are any known melt-spinning devices. For example, in the mode of single-component spinning for producing them, PVA pellets are kneaded in melt in a melt extruder, then the resulting polymer melt is introduced into a spinning head, metered with a gear pump, and spun out through a spinning nozzle, and the thus-spun fibers are wound up. In the mode of multi-component spinning for producing multi-component fibers of the invention, PVA and other thermoplastic polymers are separately kneaded in melt in different extruders, and the resulting polymer melts are all spun out through one and the same spinning nozzle.

The cross-section profile of the fibers.is not limited to only a roundish one, but maybe C-shaped or may be poly-leafed, for example, 3-leafed, T-shaped, 4-leafed, 5-leafed, 6-leafed, 7-leafed or 8-leafed, or may also be cross-shaped.

In forming PVA into fibers in the invention, it is important that PVA is melt-spun at a spinneret temperature falling between Tm and Tm+80° C., at a shear rate (γ) of from 1,000 to 25,000 $sec^{-1}$, and at a draft, V, of from 10 to 500. Where PVA is melt-spun along with other polymers to give multi-component fibers, it is desirable that the melt viscosity of PVA and that of the other polymers to be combined with PVA are near to each other, when measured at the temperature of the spinneret through which they are melt-spun and at the shear rate at which they pass through the spinning nozzle, in view of the spinning stability of the combined polymer components.

The melting point, Tm, of PVA for use in the invention is the peak temperature for the main endothermic peak of PVA seen in differential scanning calorimetry (DSC, for example, with Mettler's TA3000). The shear rate (γ) is represented by: $\gamma=4Q/\pi r^3$ in which r (cm) indicates the nozzle radius, and Q ($cm^3$/sec) indicates the polymer output rate per orifice. The draft, V, is represented by: $V=A\cdot\pi r^2/Q$ in which A (m/min) indicate the take-up speed.

In producing the fibers of the invention, if the spinneret temperature is lower than the melting point, Tm, of PVA, PVA does not melt and therefore could not be spun. If, on the other hand, it is higher than Tm+80° C., PVA will pyrolyze easily and its spinnability will become poor. If the shear rate is lower than 1,000 $sec^{-1}$, the PVA fibers being spun will be readily broken; but if higher than 25,000 $sec^{-1}$, the back pressure against the nozzle will be too high and the spinnability of PVA will be poor. If the draft is lower than 10, the fineness of the PVA fibers produced will be uneven and stable spinning of PVA is difficult; but if higher than 500, the PVA fibers being spun will be readily broken.

In the invention, adding a plasticizer to PVA to be spun is desirable, as improving spinnability of PVA.

The plasticizer is not specifically defined, and may be any compound having the ability to lower the glass transition point and the melt viscosity of PVA. For example, it includes water, ethylene glycol and its oligomer, polyethylene glycol, propylene glycol and its oligomer, butylene glycol and its oligomer, polyglycerin derivatives, glycerin derivatives as prepared by adding an alkylene oxide such as ethylene oxide, propylene oxide or the like to glycerin, sorbitol derivatives as prepared by adding an alkylene oxide such as ethylene oxide, propylene oxide or the like to sorbitol, polyalcohols such as pentaerythritol and their derivatives, PO/EO random copolymers, etc. It is desirable that the plasticizer is added to PVA in a ratio falling between 1 and 30% by weight, preferably between 2 and 20% by weight.

Preferably, at least one plasticizer selected from sorbitol-alkylene oxide adducts, polyglycerin-alkyl monocarboxylates and PO/EO random copolymers is added to PVA in a ratio falling between 1 and 30% by weight, more preferably between 2 and 20% by weight. Especially preferred are sorbitol-ethylene oxide (1 to 30 mols) adducts.

The fibers having been spun out through the spinning nozzle are directly wound up at a high take-up speed without being drawn, but if desired, they are drawn. The fibers may be drawn to a draw ratio of (elongation at break (HDmax)× 0.55 to 0.9) at a temperature not lower than the glass transition point (Tg) of PVA.

If the draw ratio is smaller than HDmax×0.55, fibers having high strength could not be obtained stably; but if larger than HDmax×0.9, the fibers will become readily broken. Regarding the drawing mode, the fibers having been spun out through the spinning nozzle are once wound up and then drawn, or are directly drawn immediately after having been spun. In the invention, the fibers may be drawn in any mode of the two. While being drawn, in general, the fibers are heated, for which any of hot air, hot plates, hot rolls, water bathes and the like are employable.

As a rule, the drawing temperature may be around Tg of the polymer constituting the fibers when the crystallized part of the non-drawn fibers is small. However, the polyvinyl alcohol for use in the invention crystallizes rapidly, and therefore the non-drawn fibers of the polymer rapidly crystallize to a relatively high degree. Accordingly, at around Tg of the polymer, the crystallized part of the non-drawn fibers could hardly undergo plastic deformation. For these reasons, even when the non-drawn fibers of the invention are drawn in a mode of contact heat drawing with, for example, hot rollers or the like, the drawing temperature for them shall be relatively high (for example, falling between 70 and 120° C. or so). On the other hand, when they are drawn under heat by the use of a non-contact heater such as a heating tube or the like, it is desirable that the drawing temperature for them is much higher than the above, for example, falling between 150 and 200° C. or so.

If the fibers are drawn at a temperature not lower than the glass transition point of the polymer constituting them but to a draw ratio overstepping the defined range of (elongation at break (HDmax)×0.55 to 0.9), the drawn fibers shall have streaky recesses running longitudinally on the surface thereof in the direction of the fiber axis. In that condition, when the drawn fibers having such streaky recesses are processed, woven or knitted in the subsequent steps, the recesses will be fibrillated to give scum while the fibers are pressed against guides and others or they receive some friction power applied thereto in the subsequent steps. The fibril scum often contaminates the woven or knitted fabrics to make the fabrics have defects, or often breaks the fibers being processed, woven or knitted. Therefore, drawing the fibers under the condition overstepping the defined range as above is unfavorable. In the present invention, the polyvinyl alcohol fibers are drawn under the condition falling within the define range as above, and therefore, the drawn fibers are substantially free from streaky recesses having a length of 0.5 $\mu$m or more and running longitudinally on the surface in the direction of the fiber axis. The drawn fibers of the invention are therefore characterized in that they are neither fibrillated nor broken in the subsequent steps of processing, weaving or knitting them. As opposed to these, PVA fibers produced in the conventional wet-spinning method, dry-jet-wet-spinning method, dry-spinning method or gel-spinning method have many streaky recesses running on the entire surface thereof In the direction of the fiber axis. In fact, in the conventional spinning methods, it is extremely difficult to produce PVA fibers free from such streaky recesses having a length of 0.5 $\mu$m or more.

The streaky recesses referred to herein are meant to indicate thin and long recesses formed on the surface of fibers, and they have a length of 0.5 $\mu$m or more and run longitudinally almost in the direction of the fiber axis. The rough structure of the fiber surface with such streaky recesses thereon can be seen by magnifying the fiber surface to 2,000 to 20,000 times with a scanning electronic microscope. As so mentioned hereinabove, the streaky recesses are almost inevitable in the conventional spinning technique of wet-spinning, dry-jet-wet-spinning, dry-spinning, gel-spinning and the like. Even in a melt-spinning method, fibers drawn to a high draw ratio to have an increased degree of orientation will often have such streaky recesses on their surface.

The cross-section profile of the fibers of the invention is not specifically defined. Being different from fibers produced through wet-spinning, dry-spinning or dry-jet-wet-spinning, the fibers of the invention are produced in any ordinary melt-spinning method, and may have any desired cross-section profile including circular, hollow or modified cross sections, depending on the shape of the spinning nozzle used. In view of the process compatibility in producing and processing the fibers and in weaving or knitting them into fabrics, it is desirable that the fibers of the invention have a circular cross-section profile.

As a rule, an oil is applied to spun fibers. Since the fibers of the invention are soluble in water and have high moisture absorbability, it is desirable to apply a water-free, straight oil to them.

The oil generally comprises a water-free antistatic component and a leveling component. For example, it may comprise any one or more selected from polyoxyethylene lauryl phosphate diethanolamine salts, polyoxyethylene cetyl phosphate diethanolamine salts, alkylimidazolium ethosulfates, cationated derivatives of polyoxyethylene laurylaminoethers, sorbitan monostearate, sorbitan tristearate, polyoxyethylene sorbitan monostearates, polyoxyethylene sorbitan tristearates, stearic acid glycerides, polyoxyethylene stearylethers, polyethylene glycol stearates, polyethylene glycol alkyl esters, polyoxyethylene castor waxes, propylene oxide/ethylene oxide (PO/EO) random ethers, PO/EO block ethers, PO/EO modified silicones, cocoyldiethanolamides, polymer amides, butyl cellosolve, mineral oils, neutral oils.

For applying the oil to the fibers, employable is any ordinary method using a contact roller or a drawing pen.

The take-up speed for the fibers varies, depending on the mode of forming the fibers. For example, the fibers are produced in a process comprising once winding up the spun fibers followed by drawing them; or a direct drawing process where the fibers are spun and immediately drawn in one step; or a non-drawing process where the fibers are spun at a high speed and directly wound up without being drawn. In any of these processes, in general, the fibers are taken up at a take-up speed falling between 500 m/min and 7000 m/min. The take-up speed for the fibers is much higher than that for fibers produced in the conventional wet-spinning, dry-jet-wet-spinning or dry-spinning method. That is, the fibers of the invention can produced at such an extremely high speed. Needless-to-say, the fibers can be produced at a take-up speed lower than 500 m/min, but such a low take-up speed is meaningless for the fibers from the viewpoint of the productivity. On the other hand, however, at a too high take-up speed over 7000 m/min, the fibers will be cut or broken.

The water-soluble PVA fibers of the invention can be controlled for their shrinkage profile in water by controlling the conditions for producing them. Where the fibers are intended not to shrink or to shrink only a little while they are in water, they are preferably subjected to heat treatment. The heat treatment may be effected along with or separately from the drawing treatment in the process where the spun fibers are drawn.

Where the fibers are subjected to the heat treatment at high temperatures, the maximum degree of shrinkage of the fibers being dissolved in water may be lowered. However, the fibers having undergone heat treatment at high temperatures will often require high dissolution temperature in water. Therefore, it is desirable to define the heat treatment conditions in consideration of the use of the fibers and of the balance between the dissolution temperature in water and the maximum degree of shrinkage of the fibers being dissolved in water. In general, the temperature for the heat treatment preferably falls between the glass transition point of PVA and (Tm−10)° C.

If the heat treatment temperature is lower than Tg, the fibers could not well crystallize to a satisfactory degree, and they will much shrink when they are formed into fabrics and subjected to heat-setting treatment. If so, in addition, the maximum shrinkage of the fibers being dissolved in hot water will be over 70%, and, as the case may be, the fibers will absorb much moisture and will be glued together while stored. On the other hand, if the heat treatment temperature is higher than (Tm−10)° C., the fibers will be unfavorably glued together when heated.

The drawn fibers may be subjected to the heat treatment while being shrunk. The fibers having undergone the heat treatment while being shrunk could have a reduced degree of shrinkage when they are dissolved in water. The degree of shrinkage to be applied to the fibers being subjected to the heat treatment preferably falls between 0.01 and 5%, more preferably between 0.1 and 4.5%, even more preferably between 1 and 4%. If the degree of shrinkage applied to them is lower than 0.01%, it is substantially ineffective for reducing the maximum degree of shrinkage of the fibers being dissolved in water. However, if the degree is larger than 5%, the fibers being shrunk at such a high degree will be loosened and stably shrinking the fibers will be impossible.

Since PVA for use in the invention is easily soluble in water, it is desirable that the PVA fibers are heat-drawing contacting to a hot plate or the like or heat-drawing in hot air or the like in which they are influenced little by water. If the PVA fibers are inevitably obliged to be drawn in a water bath, it is desirable that the temperature of the water bath is controlled to be not higher than 40° C.

Regarding the temperature of water in which the fibers are dissolved and the maximum degree of shrinkage of the fibers being dissolved in water, it is desirable, though depending on the use of the fibers, that the fibers are dissolved in water at low temperatures and the degree of shrinkage of the fibers being dissolved in water is small, in view of the economical aspect and the dimension stability of the fibers. The water dissolution temperature is meant to indicate the temperature to be measured as follows: The fibers are hung in water with a load of 2 mg/denier being applied thereto, and heated herein, and the temperature at which the fibers have broken in water is read. This is the temperature at which the fibers tested dissolve in water. On the other hand, the highest degree of shrinkage of the fibers just before dissolved in this test is read, and this is the maximum degree of the fibers having dissolved in water.

The PVA fibers of the invention are "soluble in water", and this means that the fibers dissolve in water in the test method as above, irrespective of the time taken until the fibers are dissolved.

In the invention, it is possible to produce water-soluble PVA fibers capable of dissolution in water at a temperature falling between about 10° C. and 100° C. or so, by varying the type of PVA to be used and the conditions for producing the PVA fibers. However, fibers capable of dissolving in water at low temperatures will easily absorb moisture, and their strength is often low. Therefore, in order to make the fibers have a good balance of all characteristics including easy handlability, practicability and solubility in water, it is desirable that the temperature at which the fibers degrade in water is not lower than 40° C.

The temperature at which the water-soluble fibers are processed for dissolving them may be suitably determined, depending on the temperature at which the fibers degrade and on the use of the fibers. As a rule, the processing time may be shorter when the processing temperature is higher. Where the fibers are processed in hot water, the temperature of the water is preferably not lower than 50° C., more preferably not lower than 60° C., even more preferably not lower than 70° C., most preferably not lower than 80° C. The treatment for dissolving the melt-spun fibers comprising PVA may be accompanied by decomposition of the fibers.

As the aqueous solution in which the PVA fibers are processed, generally employed is soft water, but any others such as an aqueous alkaline solution, an aqueous acidic solution and the like are also employable. The solution may contain a surfactant and a penetrant.

The maximum degree of shrinkage of the PVA fibers being dissolved in water is preferably at most 70%, more preferably at most 60%, even more preferably at most 50%, further preferably at most 40%, most preferably at most 30%. If the maximum degree of shrinkage of the PVA fibers is too large, the PVA fibers will shrunk too much, for example, when they are formed into fabrics along with other low-shrinkage synthetic fibers and the fabrics are processed in water to dissolve the PVA fibers therein. As a result, the fabrics thus processed will be warped, deformed or wrinkled, and will lose their good shape.

The PVA fibers produced in the manner mentioned above can be formed into various fibrous structures such as yarns, woven fabrics, knitted fabrics and others, either alone or as combined with any other water-insoluble fibers or hardly water-soluble fibers of which the solubility in water is lower than that of the PVA fibers. In those fibrous structures, the PVA fibers may be conjugate fibers or mixed spun fibers comprising PVA and any other thermoplastic polymers.

The PVA fibers of the invention can be used in different modes with no specific limitation, depending on their applications. For example, in one mode of using them, the PVA component may be positively left in the fibrous structures comprising them so that it serves as a binder component therein; and in another mode, the fibers comprising PVA as at least one component are combined with water-insoluble fibers to fabricate structure-modified yarns, mixed filament yarns, spun yarns and other yarns, then the yarns are formed into woven or knitted fabrics, and the fabrics are thereafter processed in water to dissolve and remove the PVA component therein, thereby forming some voids in the final products. In the latter case, the final products produced could have additional functions, and their feel could be improved. For example, they will be bulky, soft to the touch and flexible, and have heat-insulating capability. Regarding the latter case of making fibrous products have some additional functions, for example, polyester fibers or multi-component fibers comprising polystyrene as one component may be processed with an aqueous alkaline solution or an organic solvent so as to attain the intended object. In the invention, however, the fibrous structures processed with harmless water could have additional functions, and this is one characteristic feature of the invention.

The non-woven fabric of the invention comprises the fibers having, as at least one component, the modified polyvinyl alcohol (modified PVA). To fabricate it, any method is employable. For example, the fibers produced in the manner mentioned above may be formed into card webs; or the fibers are, just after having been prepared through melt-spinning, directly formed into non-woven fabrics, for example, in a spun-bonding mode or a melt-blowing mode.

The non-woven fabric may be composed of fibers of the modified PVA alone or of multi-component fibers comprising, as one component, the modified PVA and, as another component, a different water-insoluble or hardly water-soluble thermoplastic polymer of which the solubility in water is lower than that of the modified PVA and which has a melting point of not higher than 270° C. In the multi-component fibers, the type of the different thermoplastic polymer may be the same as that mentioned hereinabove for multi-component fibers.

Regarding the cross-section profile of the fibers constituting the non-woven fabric, the fibers are not limited to those having a circular cross section, but include others having various modified cross sections or having a hollow cross section.

The method of producing melt-blown non-woven fabrics comprising the modified PVA is described concretely. In the method, employable are any known melt-blowing devices such as those shown, for example, in *Industrial & Engineering Chemistry*, Vol. 48, No. 8, pp. 1342–1346, 1956. Briefly, PVA pellets are melted and kneaded in a melt extruder, and the resulting polymer melt is metered with a gear pump, introduced into the spinning nozzle of a melt-blowing device, and spun out through it into fibers while being blown by a hot air stream, then the thus-blown fibers are sheeted on a collector to form a non-woven fabric, and finally, the thus-sheeted non-woven fabric is wound up.

If desired, a cold air stream at a temperature not higher than around 40° C. may be applied to the melt-blown fibers just below the nozzle, whereby the adhesion of fibers in the non-woven fabric could be minimized. In this manner, the non-woven fabric produced could be softer.

In the method of producing the non-woven fabric of the invention in the melt-blowing manner as above, it is important that the blowing temperature is controlled to fall between (Tm+10° C.) and (Tm+80° C.). If the blowing temperature is lower than (Tm+10° C.), the melt viscosity of the polymer is too high and the polymer could not form thin fibers even when the blowing air is applied thereto at a high speed. If so, the non-woven fabric produced will have an extremely rough texture. On the other hand, if the blowing temperature is higher than (Tm+80° C.), the polymer PVA will pyrolyze and could not be stably spun into fibers.

If desired, the fibers to constitute the melt-blown non-woven fabric of the invention may be partly or wholly pressed under heat to thereby enhance the fiber-to-fiber adhesiveness in the fabric. In that condition, the fabric could have increased strength. The fibers constituting the melt-blown non-woven fabric of the invention poorly adhere to each other when they are formed into webs. Therefore, the fibers forming the webs are often pulled away and the fabric will be thereby broken. To solve the problem, the fibers are partly or wholly pressed under heat so as to be firmly fixed together, for example, through thermal embossing or thermal calendering, and the web strength is thereby increased. With the increased strength, the practical applicability of the fabric can be expanded. In the thermal pressure treatment, the temperature of the hot roll to be used, the pressure, the processing temperature and the pattern of the embossing roll to be used may be suitably determined, depending on the object of the treatment.

The PVA fibers constituting the non-woven fabric of the invention are active to water, and their apparent melting point will lower in the presence of water. Therefore, when the fabric is subjected to the thermal pressure treatment after water is applied thereto, the temperature of the hot roll to be used may be lowered.

The melt-blown non-woven fabric of thermoplastic PVA produced in the manner mentioned above may have a different degree of air-permeability. For example, it may have a degree of air-permeability of from 1 to 400 cc/cm$^2$/sec or so. However, if the mean diameter of the fibers constituting the non-woven fabric is larger than 20 $\mu$m, the fabric could not have a degree of permeability falling within that range. Therefore, it is desirable that the mean diameter of the fibers constituting the non-woven fabric is at most 20 $\mu$m.

The non-woven fabric of the invention dissolves or swells in water or absorbs water, as having high affinity for water. For example, it well dissolves even in cold water at 5° C., and therefore can be processed with water in an ordinary environmental temperature range falling between 5° C. and 30° C.

The melt-blown non-woven fabric produced in the manner as above is able to dissolve or disintegrate in water. However, if the fabric is desired to be able to dissolve or disintegrate in water at higher temperatures, it may be subjected to additional heat treatment. The heat treatment promotes the crystallization of the resinous fibers constituting the fabric. The heat treatment may be effected in the course of the process of producing the melt-blown non-woven fabric, or may be effected after the fabric produced has been wound up. The non-woven fabric having undergone the heat treatment is not dissolved in water at temperatures lower than 50° C., still keeping a degree of PVA weight retentiveness of at least 99% therein, but is rapidly dissolved in water at higher temperatures of, for example, 70° C. or higher. Thus, the heat-treated fabric has temperature-dependent degradability in water.

It is important that the non-woven fabric is subjected to the heat treatment at a temperature falling between 40° C. and Tm−5° C.

If the heat-treatment temperature is lower than 40° C., the fibers constituting the fabric could not well crystallize to a satisfactory degree at such low temperatures, and such low-temperature heat treatment is ineffective for improving the fabric to make it have the intended temperature-dependent degradability in water. On the other hand, if he heat-treatment temperature is higher than Tm−5° C., the fibers constituting the fabric will be glued together through such high-temperature heat treatment, and the fabric will have a rough and hard feel, losing a soft touch, and is unfavorable.

The heat treatment may be effected in any desired manner, except the method of directly exposing the non-woven fabric to water in a water bath. For example, the non-woven fabric maybe heated in hot air, or by the use of hot plates, hot rollers, etc. Preferably, it is heated with hot rollers with which continuous heat treatment is possible on an industrial scale. In the method of heating the non-woven fabric with such hot rollers, the non-woven fabric is kept in direct contact with hot rollers. In the heat treatment, one or both surfaces of the non-woven fabric may be heated. If desired, the non-woven fabric may be heated under pressure.

The temperature at which the non-woven fabric is dissolved disintegrated in water may be varied by varying the formulation of the polymers to form the fabric, and also by varying the fiber-blowing conditions including the temperature, the flow rate of the blowing air, etc., as well as the heat history for the post-heat-treatment of the fabric including the heat-treatment temperature and time, etc. The non-woven fabrics thus produced and processed under different conditions could have varying temperature-dependent degradability in water. For example, some are degradable in cold water, but some others are degradable only in boiling water.

The temperature of water when the non-woven fabric is dissolved or disintegrated may be suitably determined, depending on the use of the fabric. As a rule, the processing time may be shorter when the processing temperature is higher. Where the fabric is dissolved or disintegrated in hot water, the temperature of the water is preferably not lower than 50° C., more preferably not lower than 60° C., even more preferably not lower than 70° C., most preferably not lower than 80° C. The treatment for dissolving or disintegrate the melt-blown non-woven fabric comprising PVA may be accompanied by decomposition of the fibers constituting the fabric.

PVA for use in the invention is biodegradable, and, when processed with activated sludge or buried in the ground, it is degraded to give water and carbon dioxide. When its aqueous solution is continuously processed with activated sludge, PVA is almost completely degraded within 2 days to one month. In view of its biodegradability, it is desirable that PVA for fibers in the invention has a degree of saponification falling between 90 and 99.99 mol %, more preferably between 92 and 99.98 mol %, even more preferably between 93 and 99.97 mol %. It is also desirable that PVA for them has a 1,2-glycol bond content falling between 1.2 and 2.0 mol %, more preferably between 1.25 and 1.95 mol %, even more preferably between 1.3 and 1.9 mol %.

PVA having a 1,2-glycol bond content of smaller than 1.2 mol % has poor biodegradability and, in addition, its spinnability will be often poor as its melt viscosity is too high. On the other hand, PVA having a 1,2-glycol bond content of larger than 2.0 mol % has poor heat stability, and its spinnability will be often poor.

The 1,2-glycol bond content of PVA can be obtained from the peak appearing in NMR. Briefly, PVA is saponified to have a degree of saponification of at least 99.9 mol %, then fully washed with methanol, and dried at 90° C. under reduced pressure for 2 days. This is dissolved in DMSO-D6, to which are added a few drops of trifluoroacetic acid. The resulting sample is subjected to 500 MHz proton NMR (with JEOL GX-500) at 80° C. From the NMR data, obtained is the 1,2-glycol bond content of PVA.

Concretely, the methine-derived peaks for the vinyl alcohol units in PVA are assigned to the region falling between 3.2 and 4.0 ppm (integrated value A); and the methine-derived peak for one 1,2-glycol bond therein is to 3.25 ppm (integrated value B). The 1,2-glycol bond content of PVA is calculated as in the following formula in which A indicates the degree of modification (mol %).

$$\text{1,2-Glycol bond content (mol \%)}=100B/\{100A/(100-\Delta)\}$$

The fibers of the invention that comprise PVA as at least one component, and also the fibrous structures containing the fibers of the invention, such as yarns, knitted or woven fabrics, non-woven fabrics and others have many applications including, for example, binder fibers for papermaking, binder fibers for non-woven fabrics, staples for dry-process non-woven fabrics, staples for spinning, multi-filaments for knitted and woven fabrics (structure-modified yarns, mixed filament yarns), base fabrics for chemical lace, woven fabrics for robes, sewing threads, water-soluble wrapping materials; sanitary materials such as diaper liners, paper diapers, sanitary napkins, pads for incontinence, etc.; medical supplies such as surgical gowns, surgical tapes, masks, sheets, bandages, gauze, clean cotton, base fabrics for first-aid adhesive tapes, base fabrics for plasters, wound covers, etc.; wrapping materials, splicing tapes, hot-melt sheets (including temporary tacking sheets), interlinings, sheet for planting, covers for agricultural use, sheets for protecting roots, water-soluble ropes, fishing lines, reinforcing materials for cement, reinforcing materials for rubber, masking tapes, caps, filters, wiping cloths, abrasive cloths, towels, small damp towels, cosmetic puffs, cosmetic pads, aprons, gloves, table cloths; various covers such as toilet seat covers, etc.; wall cloths; air-permeable, re-wettable adhesives to be used as lining pastes for wallpapers, wall cloths, etc.; water-soluble toys, etc.

The invention is described concretely with reference to the following Examples, which, however, are not intended to restrict the scope of the invention. Unless otherwise specifically indicated, parts and % referred to in the following Examples are all by weight.

Analysis of PVA:

Unless otherwise specifically indicated, PVA was analyzed according to JIS-K6726.

To measure its degree of modification, a modified polyvinyl ester or modified PVA was subjected to 500 MHz proton NMR (with JEOL GX-500).

The alkali metal ion content of PVA was obtained through atomic absorptiometry.

Solubility in Water:

The temperature at which the PVA fibers of the invention are dissolved in water, the water dissolution temperature, was measured as follows:

With a load of 2 mg/denier being applied to them, the fibers were immersed in water along with a graded scale. The depth of the fibers being immersed in water was about 10 cm. With the fibers being immersed therein in that condition, water was heated from 20° C. up to the temperature at which the fibers began to break by dissolution, at a heating rate of 1° C./min. The temperature at which the fibers immersed in water began to break was read. While being heated so, the length of the fibers was read with the scale until the fibers broken by dissolution. Based on the change in the length of the fibers, the maximum degree of shrinkage of the fibers was obtained. Apart from this, the fibers were stirred in water at 90° C. for 1 hour, and macroscopically checked for the presence or absence of any insoluble in water.

Strength and Elongation of Fibers:

Measured according to JIS L1013.

Spinnability:

PVA was melt-kneaded in a melt extruder, the polymer melt stream was introduced into a spinning head, and metered with a gear pump. For single-component spinning, used was a nozzle with 24 orifices each having a diameter of 0.25 mm; but for multi-component spinning, used was a nozzle with 24 orifices each having a diameter of 0.4 mm. The polymer melt was spun out through the nozzle, and wound up at a rate of 800 m/min. This spinning test was continued for 6 hours. During the test, the condition of the spun fibers was all the time checked, and the spinnability of the polymer tested was evaluated as follows:

- OO: Not broken at all, the spun fibers were all wound up continuously for 6 hours.
- O: The spun fibers were broken once for 6 hours, but could be wound up for 6 hours as multi-filaments.
- O~Δ: The spun fibers were broken twice or more for 6 hours, but could be wound up for 6 hours as multi-filaments.
- Δ: The spun fibers were much broken, and could be wound up only for about 5 minutes as multi-filaments.
- x: The spun fibers were much broken and could not be wound up at all.

Degradability of Non-woven Fabrics in Water:

The degradation of the present non-woven ranges from its complete dissolution in water to its partial disintegration in water.

About 0.1 g of a square sample was cut out of a non-woven fabric to be tested, and its weight was measured. This was put into 1000 cc of distilled water having been controlled to have a predetermined temperature, and kept therein for about 30 minutes with intermittently stirring it. Then, the condition of the sample was observed. When the sample was seen to have lost the structure as a non-woven fabric by dissolution or disintegration, it was defined as "degraded".

When the sample was shrunk, swollen or warped to be in a clump, and it was impossible to macroscopically judge as to whether or not it could keep the structure of the non-woven fabric, then the sample was taken out of water. This was dried, and thereafter its weight was measured. The weight thus measured was compared with the original weight of the sample. When the weight retentiveness of the sample was at least 70%, the sample was considered as "degraded".

Weight Retentiveness of Non-woven Fabrics:

The weight retentiveness of the non-woven fabric of PVA was determined as follows:

The original weight of the non-processed fabric (this was left at 25° C. at 60% RH for 24 hours) was measured. The fabric was immersed in water at 50° C. for 30 minutes, then taken out of it, dried, and thereafter kept at 25° C. at 60% RH for 24 hours, and its weight was measured. The weight retentiveness of the fabric is represented by weight percentage of the weight of the processed fabric to the original weight of the non-processed fabric.

Strength and Elongation of Non-woven Fabrics:

Measured according to the "non-woven interlining test method" in JIS L1085.

Air Permeability of Non-woven Fabrics:

Measured according to the Method A of the "general fabric test method" in JIS L1096, for which was used a Frazier tester. Mean Diameter of Fibers Constituting Non-woven Fabrics:

With a scanning electronic microscope, pictures (×1000) of the non-woven fabric to be measured were taken, showing the surface of the fabric. Two diagonal lines were drawn on each picture, and the thickness of the fibers crossing the lines was measured. From the magnification of the microscope used, the data were converted into the actual diameter of each fiber. 100 fibers were measured and averaged to obtain the mean diameter of the fibers constituting the fabric.

On the pictures, unclear fibers and overlapped fibers, of which the diameter of one fiber could not be measured, were omitted.

EXAMPLE 1

Production of Ethylene-Modified PVA 29.0 kg of vinyl acetate and 31.0 kg of methanol were put into a 100-liter pressure container equipped with a stirrer, a nitrogen inlet, an ethylene inlet and an initiator inlet, heated at 60° C., and then purged with nitrogen by bubbling it with nitrogen for 30 minutes. Next, ethylene was introduced thereinto to make the pressure in the reactor reach 5.9 kg/cm$^2$. On the other and, an initiator, 2,2'-azobis(4-methoxy-2,4-dimethylvaleronitrile) (AMV) was dissolved in methanol to prepare a solution having an AMV concentration of 2.8 g/liter. This was purged with nitrogen by bubbling it with nitrogen. The reactor was controlled to have an inner temperature of 60° C., and 170 ml of the initiator solution was let therein. The monomers in the reactor began to polymerize in that condition. During the polymerization, ethylene was introduced into the reactor to keep the pressure in the reactor at 5.9 kg/cm$^2$ and the polymerization temperature at 60° C., while the solution of the initiator AMV was continuously led thereinto at a flow rate of 610 ml/hr. After 10 hours, the degree of polymerization reached 70%, and the system was cooled to stop the polymerization. The reactor was opened to release ethylene from it. This was bubbled with nitrogen gas to complete the ethylene release from it. Next, the non-reacted vinyl acetate monomer was removed from the reactor under reduced pressure, In the reactor, there remained a methanol solution of polyvinyl acetate. Methanol was added to the methanol solution of polyvinyl acetate to make the solution have a polymer concentration of 50%. To 200 g of the resulting methanol solution of polyvinyl acetate (this contained 100 g of polyvinyl acetate), added was 46.5 g of an alkali solution (methanol solution of 10% NaOH). The molar ratio (MR) of NaOH added herein to the vinyl acetate units in polyvinyl acetate was 0.10. With NaOH thus added thereto, the polymer was saponified. About 2 minutes after the alkali addition, the system gelled. This was ground by the use of a grinder, and left at 60° C. for 1 hour. During that, the polymer was further saponified. Next, 1000 g of methyl acetate was added to this to neutralize the remaining alkali. The system was tested with an indicator, phenolphthalein added thereto, and its complete neutralization was confirmed. Then, this was filtered to separate a white solid of PVA. 1000 g of methanol was added to this, and left at room temperature for 3 hours. Thus, the white solid was washed with methanol added thereto. The washing operation was repeated three times. Next, this was centrifuged to remove the liquid component from it, and the resulting PVA was left in a drier at 70° C. for 2 days. Thus was obtained a dried PVA.

The ethylene-modified PVA thus obtained in the manner as above had a degree of saponification of 98.4 mol %. The modified PVA was washed, dissolved in acid, and subjected to atomic absorptiometry. The sodium content of the modified PVA thus measured was 0.03 parts by weight relative to 100 parts by weight of the modified PVA.

On the other hand, the methanol solution of polyvinyl acetate having been obtained by removing the non-reacted vinyl acetate monomer from the polymerization system as above was purified through precipitation in n-hexane followed by dissolution in acetone. The process of purification was repeated three times. After thus purified, this was dried at 80° C. under reduced pressure for 3 days to obtain pure polyvinyl acetate. The pure polyvinyl acetate was dissolved in DMSO-d6, and subjected to 500 MHz proton NMR (with JEOL GX-500) at 80° C. The ethylene content of the polymer was found to be 10 mol %. The methanol solution of polyvinyl acetate was saponified with an alkali having a molar ratio of 0.5, ground, and then left at 60° C. for 5 hours to promote the saponification of the polymer. This was subjected to Soxhlet extraction with methanol for 3 days, and then dried at 80° C. under reduced pressure for 3 days to obtain pure, ethylene-modified PVA. The mean degree of polymerization of this PVA was measured according to an ordinary method as in JIS K6726, and it was 330. The 1,2-glycol bond content of the pure PVA and the three-chain hydroxyl content thereof were measured through 500 MHz proton NMR (with JEOL GX-500) according to the methods mentioned hereinabove, and were 1.50 mol % and 83 mol %, respectively.

An aqueous solution of 5% pure modified PVA was prepared, and cast to form a film having a thickness of 10 microns. The film was dried at 80° C. under reduced pressure for 1 day. This was subjected to DSC (with Mettler's TA3000) according to the method mentioned hereinabove to measure the melting point of PVA, which was 206° C. (see Table 1).

TABLE 1

| Example | Degree of Polymerization | Degree of Saponification (mol %) | Tm (° C.) | Monomer for Modification | Degree of Modification (mol %) | OH of central vinyl alcohol uint in 3successive vinylalcohol unit chain (mol %) | Carboxylic acid and Lactone Ring Content (mol %) | Sodium Ion Content (parts by weight) | 1,2-Glycol Bond Content (mol %) |
|---|---|---|---|---|---|---|---|---|---|
| Ex. 1 | 330 | 98.4 | 206 | ethylene | 10 | 83 | 0.07 | 0.03 | 1.5 |
| Ex. 2, 28, 61 | 280 | 95.7 | 186 | ethylene | 10 | 82 | 0.08 | 0.3 | 1.5 |
| Ex. 3, 29, 62 | 230 | 98.9 | 205 | ethylene | 13 | 78 | 0.03 | 0.7 | 1.6 |
| Ex. 4, 30, 63 | 480 | 91.3 | 180 | ethylene | 4 | 91 | 0.11 | 0.0005 | 1.95 |
| Ex. 5, 31, 64 | 440 | 98.4 | 204 | propylene | 3 | 93 | 0.1 | 0.001 | 1.7 |
| Ex. 6, 32, 65 | 250 | 98.4 | 202 | ethylene glycol vinyl ether | 3 | 93 | 0.09 | 0.03 | 1.7 |
| Ex. 7, 33, 66 | 330 | 98.3 | 180 | ethyl vinyl ether | 6 | 88 | 0.04 | 0.03 | 1.6 |
| Ex. 8, 34, 67 | 280 | 93.7 | 182 | ethyl vinyl ether | 2 | 93 | 0.09 | 0.001 | 1.75 |
| Ex. 9, 35, 68 | 440 | 98.4 | 168 | ethyl vinyl ether | 8 | 84 | 0.02 | 0.001 | 1.5 |
| Ex. 10, 36, 69 | 330 | 96.9 | 170 | ethylene + ethyl vinyl ether | 15 + 4 | 73 | 0.05 | 0.03 | 1.2 |
| Ex. 11, 37, 70 | 230 | 99.8 | 224 | 5-hepten-1-ol | 1.2 | 96 | 0.07 | 0.0006 | 1.8 |
| Ex. 12, 71 | 280 | 95.7 | 181 | ethylene | 10 | 82 | 0.08 | 0.03 | 2.2 |
| Ex. 13, 72 | 480 | 91.3 | 185 | ethylene | 4 | 91 | 0.11 | 0.03 | 1 |
| Comp.Ex.1 | 230 | 99.7 | 232 | none | — | 99 | 0.14 | 0.03 | 1.45 |
| Comp.Ex.2 | 330 | 99.1 | 155 | ethyl vinyl ether | 10 | 85 | 0.03 | 0.03 | 1.5 |
| Comp.Ex.3 | 330 | 98.4 | 206 | ethylene | 10 | 83 | 0.07 | 0.0001 | 1.5 |
| Comp.Ex.4 | 330 | 98.4 | 206 | ethylene | 10 | 83 | 0.07 | 1.4 | 1.5 |
| Comp.Ex.5 | 440 | 98.3 | 220 | none | — | 99.95 | 0.21 | 0.3 | 1.7 |
| Comp.Ex.6 | 330 | 99.8 | 170 | ethylene + ethyl vinyl ether | 14 + 7 | 68 | 0.03 | 0.03 | 1.2 |
| Comp.Ex.7 | 250 | 98.9 | 198 | ethylene | 21 | 65 | 0.01 | 0.03 | 1.4 |

The modified PVA prepared above was melted and kneaded in a melt extruder at 240° C., the polymer melt stream was introduced into a spinning head, metered with a gear pump, spun out through a spinning nozzle with 24 orifices each having a diameter of 0.25 mm, and wound up at a rate of 800 m/min. The spinning operation was continued for 6 hours. The shear rate was 8,200 $sec^{-1}$, and the draft was 52. The non-drawn, spun fibers were then drawn to a draw ratio of 2.0 (this corresponds to HDmax×0.7) in a roller-on-plate drawing mode, for which the hot roller temperature was 75° C., and the hot plate temperature was 170° C. The overall profile of the drawn fibers was 75 d/24 f. Each drawn fiber had a uniform, true circular cross-section profile. Its surface was observed with a scanning electronic microscope (×2000), and no streaky recess having a length of 0.5 μm or more was found thereon. The strength, the elongation and the solubility in water of the drawn fibers, the temperature at which the drawn fibers were dissolved in water, and the maximum degree of shrinkage of the drawn fibers before their dissolution in water are all shown in Table 2.

TABLE 2

| Example | Spinning Temp. (° C.) | Hot Roller Temp. (° C.) | Hot Plate Temp. (° C.) | Draw Ratio | Spinnability | Solubility in Water | Water Dissolution Temp. (° C.) | Maximum Degree of Shrinkage (%) | Strength (g/d) | Elongation (%) |
|---|---|---|---|---|---|---|---|---|---|---|
| Ex. 1 | 240 | 75 | 170 | HDmaxx0.7 | ○○ | ○○ | 66 | 38 | 3.1 | 32.8 |
| Ex. 2 | 210 | 75 | 150 | x0.7 | ○○ | ○○ | 55 | 33 | 2.5 | 33.4 |
| Ex. 3 | 240 | 75 | 170 | x0.67 | ○ | ○ | 63 | 18 | 2.2 | 35.6 |
| Ex. 4 | 210 | 75 | 150 | x0.8 | ○ | ○ | 54 | 72 | 3.7 | 22.9 |
| Ex. 5 | 230 | 75 | 170 | x0.8 | ○○ | ○○ | 65 | 60 | 3.5 | 23.1 |
| Ex. 6 | 230 | 75 | 170 | x0.6 | ○○ | ○ | 60 | 19 | 2.9 | 24.1 |
| Ex. 7 | 210 | 75 | 150 | x0.7 | ○○ | ○○ | 54 | 44 | 2.3 | 22.3 |
| Ex. 8 | 210 | 75 | 150 | x0.6 | ○ | ○ | 52 | 37 | 2.1 | 24.4 |
| Ex. 9 | 200 | 75 | 140 | x0.8 | ○ | ○ | 33 | 65 | 3.6 | 28.8 |
| Ex. 10 | 200 | 75 | 140 | x0.65 | ○ | ○○ | 35 | 40 | 2 | 40.8 |
| Ex. 11 | 250 | 100 | 180 | x0.6 | ○ | ○ | 74 | 18 | 2.2 | 17.6 |
| Ex. 12 | 210 | 75 | 150 | x0.7 | ○~Δ | ○ | 57 | 35 | 2.1 | 30.3 |
| Ex. 13 | 220 | 75 | 150 | x0.7 | ○~Δ | ○ | 52 | 69 | 3.5 | 21.8 |
| Ex. 14 | 240 | Temp. of Hot Roller 1<br>85 | Temp. of Hot Roller 2<br>160 | x0.72 | ○○ | ○○ | 68 | 19 | 3.5 | 33.5 |
| Ex. 15 | 210 | 85 | 130 | x0.81 | ○ | ○ | 55 | 48 | 3.9 | 28.3 |
| Ex. 16 | 230 | 85 | 150 | x0.81 | ○○ | ○○ | 66 | 30 | 3.5 | 25.2 |
| Ex. 17 | 210 | 85 | 130 | x0.72 | ○○ | ○○ | 55 | 28 | 2.5 | 24.9 |
| Ex. 18 | 200 | 85 | 120 | x0.81 | ○ | ○ | 34 | 49 | 3.7 | 30.2 |
| Ex. 19 | 200 | 85 | 120 | x0.66 | ○ | ○○ | 35 | 22.1 | 2.4 | 42.1 |
| Comp. Ex. 1 | 250 | Hot Roller Temp.<br>— | Hot plate Temp.<br>— | — | x | — | — | — | — | — |

TABLE 2-continued

| Example | Spinning Temp. (° C.) | Hot Roller Temp. (° C.) | Hot Plate Temp. (° C.) | Draw Ratio | Spinnability | Solubility in Water | Water Dissolution Temp. (° C.) | Maximum Degree of Shrinkage (%) | Strength (g/d) | Elongation (%) |
|---|---|---|---|---|---|---|---|---|---|---|
| Comp. Ex. 2 | 180 | — | — | — | x | Δ | — | — | — | — |
| Comp. Ex. 3 | 240 | 75 | 170 | x0.7 | Δ | Δ | — | 51 | 2.8 | 15.3 |
| Comp. Ex. 4 | 240 | — | — | — | x | — | — | — | — | — |
| Comp. Ex. 5 | 250 | 100 | 180 | x0.7 | Δ | Δ | — | 66 | 3.5 | 16.7 |
| Comp. Ex. 6 | 200 | — | — | — | x | — | — | — | — | — |
| Comp. Ex. 7 | 230 | 75 | 150 | x0.7 | ○○ | x | — | — | 2.5 | 24.5 |
| Comp. Ex. 8 | 240 | 40 | 170 | x0.95 | 0 | ○ | 82 | 28 | 4.5 | 10.1 |

Solubility in Water: ○○: Very good. ○: Good. Δ; Some insoluble remained. x: Not dissolved.

Next, using a tubular-knitting machine, the drawn fibers were knitted into fabrics. While being knitted, the fibers were not fibrillated at all.

The drawn PVA filaments prepared above were combined with non-drawn filaments of polyethylene terephthalate (limiting viscosity: 0.68) having a degree of elongation at break of 162% (85 d/48 f) and drawn filaments of polyethylene terephthalate (limiting viscosity: 0.67) having a degree of elongation at break of 32% (50 d/12 f) to form combined yarns through interlacing at an overfeed ratio of 5.5%, and the combined yarns were false-twisted at a draw ratio of 1.072, at a ratio of friction disc/yarn processing speed (D/Y) of 1.782, at a false-twisting rate of 255 m/min, and at a temperature of the first heater of 180° C. to prepare structure-modified polyester yarns.

The structure-modified polyester yarns prepared above were twisted to a count of 800 twists/m, using a double twister. The thus-twisted, structure-modified polyester yarns were used as the weft, along with ordinary structure-modified polyethylene terephthalate yarns [135 d/60 f; sheath 85 d/48 f; core 50 d/12 f—these were twisted to a count of 1800 twists/m] serving as the warp, and woven into a ½ twill woven fabric. In this, the ratio by weight of weft/warp was 1/1. The non-processed fabric was subjected to scouring-relaxation with soda ash, pre-set at 190° C., and then treated in hot water at 95° C. for 60 minutes, whereby all the drawn PVA fibers in the fabric were dissolved and removed.

The thus-processed fabric was washed with water, dried and dyed in an ordinary manner, and then finally set at a temperature of 170° C. In the final setting step, the fabric was not tented but a tension was applied thereto to such a degree that the fabric could be unwrinkled under the tension.

The fabric thus obtained in the manner as above felt soft and light, and it had good flexibility and harikosi(being tough against pressure applied thereto). The cross section of the fabric was observed with an electronic microscope, and a highly vacant structure was found in the yarns constituting the fabric.

In preparing the fibers of Example 1, a plasticizer of sorbitol-ethylene oxide adduct (½ by mol) was added to the modified PVA in a ratio of from 3 to 20% by weight. In this case, the fibers were produced more stably than those with no plasticizer added. Regarding the solubility profile in water, the fibers with the plasticizer added dissolved better in water than those with no plasticizer added, and, in addition, the amount of the dissolved substance from the former adhered to the wall of the container was smaller than that from the latter.

EXAMPLES 2 to 13

Drawn PVA fibers were prepared in the same manner as in Example 1, except that PVA shown in Table 1 was used in place of the PVA used in Example 1 and that the spinning temperature and the conditions for drawing and heat treatment were varied to those shown in Table 2. The spinnability of PVA used; the strength, the elongation and the solubility in water of the drawn fibers; the water dissolution temperature at which the drawn fibers were broken in water; and the maximum degree of shrinkage of the drawn fibers before their breaking in water are shown in Table 2.

The drawn PVA filaments prepared in Example 2 were combined with polyethylene terephthalate filaments having an Y-shaped cross section (these contained 3%by weight of silica, and had a limiting viscosity [η] of 0.65, a degree of shrinkage in boiling water of 3.5%, a degree of shrinkage under dry heat, DSr, of 5.0%, and an overall profile of 75 d/48 f) and with polyethylene terephthalate filaments having a round cross section (these contained 3% by weight of silica, and had a limiting viscosity [η] of 0.65, a degree of shrinkage in boiling water of 14%, a degree of shrinkage under dry heat, DSr, of 18%, and an overall profile of 75 d/24 f), and entangled in a flowing air to obtain combined filament yarns. The process stability was good, and these were well formed into the intended yarns with no trouble.

The thus-obtained yarns were woven into a 1/1 plain-woven fabric, in which the yarns served as both the weft and the warp, and the ratio of weft/warp was 1/1. The weaving process stability was also good, and the yarns were well woven into the intended fabric with no trouble. The plain-woven fabric was subjected to scouring-relaxation, and then boiled in water for 60 minutes. Through the process, the drawn PVA fibers were selectively dissolved in water. The thus-processed fabric was bulky and felt soft, and it was flexible and tough against pressure applied thereto.

EXAMPLE 14

The non-drawn fibers prepared in Example 1 were drawn under heat with a first roller at 85° C., a second roller at 160° C. and a third roller at 30° C. in such a manner that they were drawn to a draw ratio of 2.06 (corresponding to HDmax× 0.72) between the first roller and the second roller while being shrunk by 3% between the second roller and the third roller. The thus-drawn fibers had an overall profile of 75 d/24 f. The strength, the elongation and the solubility in water of the drawn fibers; the water dissolution temperature at which the drawn fibers were broken in water; and the maximum degree of shrinkage of the drawn fibers before their breaking in water are shown in Table 2.

Next, the drawn PVA fibers were twisted to a count of 250 twists/m. Using the twisted yarns for the warp and the non-twisted yarns of the drawn fibers for the weft, a plain-woven fabric was prepared (120 yarns/inch for the warp, and 95 yarns/inch for the weft). This serves as the base fabric for chemical lace to be produced herein. A pattern designed for tulle lace for inner wear was embroidered on the base fabric to prepare a sample of chemical lace, for which were used embroidery threads of rayon yarn. This was processed in hot water at 98° C. to finish the chemical lace with tulle. Through the hot water treatment, the base fabric of the PVA fibers was completely dissolved in water, and the finished chemical lace had a fine and clear embroidered tulle pattern.

EXAMPLE 15

Drawn PVA fibers were produced in the same manner as in Example 14, except that the non-drawn PVA fibers of Example 4 as spun at the spinning temperature shown in Table 2 were drawn under heat to the draw ratio as in Table 2. The strength, the elongation and the solubility in water of the drawn fibers; the water dissolution temperature at which the drawn fibers were broken in water; and the maximum degree of shrinkage of the drawn fibers before their breaking in water are shown in Table 2.

EXAMPLE 16

Drawn PVA fibers were produced in the same manner as in Example 14, except that the non-drawn PVA fibers of Example 5 as spun at the spinning temperature shown in Table 2 were drawn under heat to the draw ratio as in Table 2. The strength, the elongation and the solubility in water of the drawn fibers; the water dissolution temperature at which the drawn fibers were broken in water; and the maximum degree of shrinkage of the drawn fibers before their breaking in water are shown in Table 2.

EXAMPLE 17

Drawn PVA fibers were produced in the same manner as in Example 14, except that the non-drawn PVA fibers of Example 7 as spun at the spinning temperature shown in Table 2 were drawn under heat to the draw ratio as in Table 2. The strength, the elongation and the solubility in water of the drawn fibers; the water dissolution temperature at which the drawn fibers were broken in water; and the maximum degree of shrinkage of the drawn fibers before their breaking in water are shown in Table 2.

EXAMPLE 18

Drawn PVA fibers were produced in the same manner as in Example 14, except that the non-drawn PVA fibers of Example 9 as spun at the spinning temperature shown in Table 2 were drawn under heat to the draw ratio as in Table 2. The strength, the elongation and the solubility in water of the drawn fibers; the water dissolution temperature at which the drawn fibers were broken in water; and the maximum degree of shrinkage of the drawn fibers before their breaking in water are shown in Table 2.

EXAMPLE 19

Drawn PVA fibers were produced in the same manner as in Example 14, except that the non-drawn PVA fibers of Example 10 as spun at the spinning temperature shown in Table 2 were drawn under heat to the draw ratio as in Table 2. The strength, the elongation and the solubility in water of the drawn fibers; the water dissolution temperature at which the drawn fibers were broken in water; and the maximum degree of shrinkage of the drawn fibers before their breaking in water are shown in Table 2.

EXAMPLE 20

PVA prepared in Example 1 was melted and kneaded in a melt extruder at 240° C., the polymer melt stream was introduced into a spinning head, metered with a gear pump, spun out through a spinning nozzle with 48 orifices each having a diameter of 0.4 mm, and wound up at a rate of 800 m/min. The shear rate was 2,000 $sec^{-1}$ and the draft was 136. The non-drawn, spun fibers were then drawn in hot air furnaces to a draw ratio of 2.5 (this corresponds to HDmax× 0.8), for which the temperature of the first furnace was 150° C. and that of the second furnace was 170° C. The overall profile of the drawn fibers was 150 d/48 f. Each drawn fiber had a uniform, true circular cross-section profile. Its surface was observed with a scanning electronic microscope (×2000), and no streaky recess having a length of 0.5 $\mu$m or more was found thereon. The spinnability of PVA used; the solubility in water of the drawn fibers; the water dissolution temperature at which the drawn fibers were broken in water; and the maximum degree of shrinkage of the drawn fibers before their breaking in water are shown in Table 3. Using a tubular-knitting machine, the drawn fibers were knitted into fabrics. While being knitted, the fibers were not fibrillated at all.

TABLE 3

| Example | Spinnability | Solubility in Water | Water dissolution Temp. (° C.) | Maximum Degree of Shrinkage (%) | Compatibility with Tubular-Knitting Machine |
|---|---|---|---|---|---|
| Example 20 | OO | OO | 68 | 36 | O |
| Example 21 | OO | OO | 70 | 19 | O |
| Example 22 | OO | OO | 59 | 24 | O |
| Example 23 | O | OO | 30 | 30 | O |

Solubility in Water:
OO: Very good.
O: Good.
Δ: Some insoluble remained.
x: Not dissolved.

EXAMPLE 21

The non-drawn fibers prepared in Example 9 were drawn under heat in the first furnace at 150° C. to a draw ratio of 2.5 (this corresponds to HDmax×0.8), and then further heated in the second furnace at 180° C. with no tension applied thereto. The overall profile of the drawn fibers was 150 d/48 f. Each drawn fiber had a uniform, true circular cross-section profile. Its surface was observed with a scanning electronic microscope (×2000), and no streaky recess having a length of 0.5 $\mu$m or more was found thereon. The spinnability of PVA used; the solubility in water of the drawn fibers; the water dissolution temperature at which the drawn fibers were broken in water; and the maximum degree of shrinkage of the drawn fibers before their breaking in water are shown in Table 3. Using a tubular-knitting machine, the drawn fibers were knitted into fabrics. While being knitted, the fibers were not fibrillated at all.

EXAMPLE 22

PVA prepared in Example 1 was melted and kneaded in a melt extruder at 240° C., the polymer melt stream was introduced into a spinning head, metered with a gear pump, spun out through a spinning nozzle with 24 orifices each having a diameter of 0.25 mm, immediately drawn under heat in a tube heater at 180° C., and wound up at a rate of 4,000 m/min. The shear rate was 8,200 $sec^{-1}$, and the draft was 260. The surface of each drawn fiber was observed with a scanning electronic microscope (×2000), and no streaky recess having a length of 0.5 μm or more was found thereon. The spinnability of PVA used; the solubility in water of the drawn fibers; the water dissolution temperature at which the drawn fibers were broken in water; the maximum degree of shrinkage of the drawn fibers before their breaking in water; and the compatibility of the fibers with a tubular-knitting machine are shown in Table 3.

EXAMPLE 23

PVA prepared in Example 1 was melted and kneaded in a melt extruder at 240° C., the polymer melt stream was introduced into a spinning head, metered with a gear pump, spun out through a spinning nozzle with 24 orifices each having a diameter of 0.25 mm, and wound up at a rate of 5,500 m/min. The shear rate was 20,800 $sec^{-1}$, and the draft was 140. The overall profile of the fibers was 75 d/24 f. Each drawn fiber had a uniform, true circular cross-section profile. Its surface was observed with a scanning electronic microscope (×2000), and no streaky recess having a length of 0.5 μm or more was found thereon.

Using a tubular-knitting machine, the fibers were knitted into fabrics. While being knitted, the fibers were not fibrillated at all. The spinnability of PVA used; the solubility in water of the fibers; the water dissolution temperature at which the fibers were broken in water; the maximum degree of shrinkage of the fibers before their breaking in water; and the compatibility of the fibers with a tubular-knitting machine are shown in Table 3.

COMPARATIVE EXAMPLES 1, 2

Drawn PVA fibers were produced in the same manner as in EXAMPLE 1, except that PVA shown in Table 1 was used in place of the PVA used in Example 1, that PVA was spun at the spinning temperature shown in Table 2 and that the spun fibers were drawn to the draw ratio as in Table 2. The spinnability of PVA used; the strength, the elongation and the solubility in water of the drawn fibers; the water dissolution temperature at which the drawn fibers were broken in water; and the maximum degree of shrinkage of the drawn fibers before their breaking in water are shown in Table 2.

In Comparative Example 1, the polymer PVA did not melt sufficiently at the spinning temperature of 250° C., and, in addition, the polymer melt could not be well spun out through the spinning pack as its viscosity was too high at that spinning temperature. Therefore, the spinning temperature was elevated to 270° C. At the elevated temperature, however, the polymer PVA would have pyrolyzed, and its spinnability was so poor that its fibers could not be wound up. In Comparative Example 2, the crystallinity of PVA used would be poor. As a result, the spun fibers of PVA were partly glued together while they were heated or as they absorbed water, and the glued fibers could not be unglued. The glued fibers were checked for their solubility in water. It was found that they swelled and dissolved in water in some degree, but formed lumps not completely soluble in water.

COMPARATIVE EXAMPLE 3

PVA was prepared in the same manner as in Example 1. In this, however, the polymer was, after having been washed four times with methanol as in Example 1, further washed three times with a mixed solution of methanol/water=90/10 to thereby reduce the sodium ion content of the polymer to 0.0001 parts by weight. The polymer PVA thus prepared herein was spun in the same manner as in Example 1. As the polymer would have gelled, winding up its fibers was possible only within an extremely short period of time (about 5 minutes). The non-drawn fibers were drawn in the same manner as in Example 1, and processed in water at 90° C. for 1 hour. However, they gave some insoluble in water, and could not dissolve completely (see Table 2).

COMPARATIVE EXAMPLE 4

PVA was prepared in the same manner as in Example 1. In this, however, the polymer was not washed with methanol so that its sodium content could be 1.4 parts by weight. Spinning the polymer PVA thus prepared herein was tried, but in vain, as the polymer pyrolyzed and winding up its fibers was impossible (see Table 2).

COMPARATIVE EXAMPLES 5 to 7

Drawn PVA fibers were produced in the same manner as in Example 1, except that PVA shown in Table 1 was used in place of the PVA used in Example 1, that PVA was spun at the spinning temperature shown in Table 2 and that the spun fibers were drawn to the draw ratio as in Table 2. The spinnability of PVA used; the strength, the elongation and the solubility in water of the drawn fibers; the water dissolution temperature at which the drawn fibers were broken in water; and the maximum degree of shrinkage of the drawn fibers before their breaking in water are shown in Table 2.

While being spun, PVA in Comparative Example 5 pyrolyzed and gelled, and its spinnability was poor. Winding up its fibers was possible only within an extremely short period of time (about 5 minutes). The non-drawn fibers were drawn in the same manner as in Example 1, and processed in water at 90° C. for 1 hour. However, they gave some insoluble in water, and could not dissolve completely (see Table 2).

In Comparative Example 6, the melt viscosity of the polymer PVA was too high at the spinning temperature of 200° C., and the polymer PVA could not be well spun out through the spinning pack at the temperature. Therefore, the spinning temperature was elevated to 240° C. At the elevated temperature, however, the polymer pyrolyzed and gelled while being spun, and its spinnability was poor. Winding up its fibers was possible only within an extremely short period of time (about 5 minutes). The non-drawn fibers were drawn in the same manner as in Example 1, and processed in water at 90° C. for 1 hour. However, they gave some insoluble in water, and could not dissolve completely.

In Comparative Example 7, the spinnability of PVA was very good and the drawn fibers were produced with no trouble. However, the drawn fibers processed in water at 90° C. for 1 hour did not dissolve at all.

COMPARATIVE EXAMPLE 8

The non-drawn fibers prepared in Example 1 were drawn to a draw ratio of HDmax×0.95 in a roller-on-plate drawing mode, for which the hot roller temperature was 40° C., and the hot plate temperature was 150° C. In this, however, the fibers being drawn were much broken, and could be wound up only within an extremely short period of time. When observed microscopically, the fibers were found having many fibrils formed therearound. When observed with a scanning electronic microscope (×2,000), the surface of each fiber was found having thereon a large number of streaky recesses of 0.5 μm or more in length. The fibers produced herein were not on the practicable level.

EXAMPLE 24

PVA prepared in Example 1, and a modified polyethylene terephthalate copolymerized with 8 molt of isophthalic acid (this contained 1.0 part by weight of silica having a primary mean particle size of 0.04 μm, and had a reduced viscosity of 0.75 in orthochlorophenol (concentration: 1 g/dl) at 30° C.) were separately melted, and fed into a spinning head, through which the polymers were spun out to give a multi-layered bi-component fiber composed of 6 layers of the modified polyester and 5 layers of PVA. The head is provided with a spinning nozzle having 24 round orifices. The spinning nozzle is so constituted that the metering part has a diameter of 0.25 mmϕ, the land length is 0.5 mm, and each orifice has a bell-wise expanded opening having a diameter of 0.5 mmϕ. The spinning temperature was 260° C.

Just below the spinneret, disposed was a cold air blowing device having a length of 1.0 m and capable of blowing cold air in the horizontal direction. The bi-component fibers having been spun out through the spinneret were directly introduced into the cold air blowing device, in which the fibers were exposed to cold air (this was controlled at 25° C. and 65 RH %) at an air flow of 0.5 m/sec, whereby the fibers were cooled to 50° C. or lower. The temperature of the fibers at around the outlet of the cold air blowing device was 40° C.

The bi-component fibers having been thus cooled to 50° C. or lower were then introduced into a tube heater having a length of 1.0 m and an inner diameter of 30 mm (this was disposed below the spinneret, as spaced by 1.6 m from the spinneret, and its inner wall temperature was 180° C.), and drawn therein. An oily agent was applied to the drawn fibers having passed through the tube heater, in a guide-oiling mode. Then, the fibers were wound up via a pair of two take-up rollers, at a take-up speed of 4000 m/min. The drawn bi-component fibers thus produced had an overall profile of 75 deniers/24 filaments.

The process stability was good with no trouble. The bi-component fibers were knitted into a tubular fabric. This was then processed in hot water at 98° C. for 60 minutes. The PVA component was completely dissolved away from the fabric, and split fibers of the modified polyester only were obtained.

EXAMPLE 25

Bi-component fibers were prepared in the same melt-spinning method as in Example 24. In this, however, a polyamide (limiting viscosity: 0.9, $CONH/CH_2$=1/3.9, polymerization composition: 19.5 mol % of terephthalic acid, 10 mol % of 1,9-nonanediamine, 10 mol % of 2-methyl-1,8-octanediamine, 1 mol % of benzoic acid, and 0.06 mol % of $NaH_2PO_2 \cdot H_2O$) was used in place of the modified polyethylene terephthalate used in Example 24, and it was melt-spun at a spinning temperature of 260° C. The thus-spun, bi-component fibers were cooled to 50° C. or lower.

The non-drawn bi-component fibers were taken up at a take-up speed of 1000 m/min, and, without being wound up, these were directly drawn to a draw ratio of 3.5 at a take-up speed of 3500 m/min, while being set under heat at 150° C. The thus-drawn bi-component fibers had an overall profile of 75 deniers/24 filaments.

The process stability was good with no trouble. The bi-component fibers were knitted into a tubular fabric. This was then processed in hot water at 98° C. for 60 minutes. The PVA component was completely dissolved away from the fabric, and split fibers of the polyamide only were obtained.

Next, the tubular fabric was dyed in black with a disperse dye under the conditions shown below.

| | |
|---|---|
| Kayalon polyester Black G-SF | 12% owf |
| Tohosalt TD | 0.5 g/liter |
| Ultra Mt-N2 | 0.7 g/liter |
| Bath ratio | 50:1 |

Dyed in the bath at 135° C. for 40 minutes.

After having been thus dyed, the fabric was washed in a reducing manner at 80° C.

The degree of exhaustion of the colorant in the bath was 80%, and the fabric was well colored. The colored fabric was tested for the color fastness according to the Method A-2 in JIS L-0844 in which the liquid contaminated with the dye released from the fabric was measured. It was verified that the colored fabric had good color fastness on the level of class 5.

EXAMPLE 26

PVA prepared in Example 1, and a polyethylene terephthalate (PET, this contained 1.0 part by weight of silica having a primary mean particle size of 0.04 μm, and had a reduced viscosity of 0.68 in orthochlorophenol (concentration: 1 g/dl) at 30° C.) were separately melted, and spun out through a core/sheath spinning nozzle in a blend ratio of PVA/PET=¼ to give core/sheath fibers in which PVA formed the sheath and PET formed the core. The spinning temperature was 285° C. The fibers were drawn in the same manner as in Example 24. The drawn bi-component fibers had an overall profile of 75 deniers/24 filaments.

The process stability was good with no trouble. The bi-component fibers were woven into a habutae fabric (raw plain-woven fabric with 87 yarns/inch for the weft and 120 yarns/inch for the warp) in which both the warp and the weft were of the bi-component fabrics. The fabric was processed in hot water at 98° C. for 60 minutes. The PVA component was completely dissolved away from the fabric. The processed fabric had a good feel, like conventional polyester fabrics processed with alkali for weight reduction.

EXAMPLE 27

PVA prepared in Example 1, and polylactic acid having a D-form content of 1% (melting point: 170° C.) were separately melted and kneaded in different extruders, led into a spinning pack heated at 240° C. in such a manner that the modified PVA could be on the sea side and the polylactic acid on the island side, and spun out through a bi-component spinning nozzle with 24 orifices each having a diameter of 0.4 mmϕ. The polymer delivery rate was 24 g/min; the shear rate was 2,400 $sec^{-1}$; and the draft was 110; and the fiber take-up speed was 800 m/min. Thus were produced 1/1 sea/island bi-component fibers in which the number of islands was 16. These were drawn in a hot air furnace at 150° C. to a draw ratio of 3 (corresponding to HDmax×0.7). The drawn bi-component fibers had a single fiber fineness of 4 deniers. The spinning and drawing conditions, the fiber spinnability, and the strength and the elongation of the fibers obtained are shown in Table 4.

The bi-component fibers were knitted into a tubular fabric. This was processed in hot water at 95° C. for 1 hour to remove the PVA component from it. As a result, obtained was a knitted fabric of polylactic acid fibers only. The fabric had a good feel. This fabric was undone, and the fibers having constituted it were analyzed. These were ultra-fine fibers having a fineness of about 0.13 deniers, and their physical properties were good. From the waste water containing the PVA component released from the fabric, the PVA component was extracted out and analyzed for the waste load and the biodegradability (see Table 5).

The biodegradability of the PVA extract from the waste water was evaluated according to the method mentioned below.

Biodegradability of PVA Extract:

This was measured in the same manner as in JIS-K-6950, except that the amount of the activated sludge used was 30 mg but not 9 mg. Precisely, 30 mg of activated sludge and 30 mg of an aqueous solution of the PVA extract (this was prepared by drying the extract, measuring its weight and dissolving it in water) were put into an inorganic culture medium, and incubated therein at 25° C. for 28 hours. During the incubation, the amount of oxygen consumed for biodegrading the PVA extract was measured with a coulometer (Ohkura Electric's Model OM3001A). Based on the data measured, the biodegradability of the PVA extract was determined.

TABLE 4

| Example | Spinning Temp. (° C.) | Draw Ratio | Spinnability | Extractant | Extrability | Feel | Strength (g/d) | Elongation (%) |
|---|---|---|---|---|---|---|---|---|
| Example 27 | 240 | 3 | ○○ | hot water | ○○ | ○○ | 3.5 | 31.5 |
| Example 28 | 230 | 2.5 | ○ | hot water | ○○ | ○ | 2.7 | 40.2 |
| Example 29 | 240 | 2.4 | ○ | hot water | ○ | ○ | 2.5 | 43.5 |
| Example 30 | 230 | 3.3 | ○ | hot water | ○ | ○ | 3.7 | 28.9 |
| Example 31 | 230 | 3.2 | ○○ | hot water | ○○ | ○○ | 3.6 | 27.8 |
| Example 32 | 230 | 2.4 | ○○ | hot water | ○ | ○ | 2.4 | 45.2 |
| Example 33 | 230 | 2.9 | ○ | hot water | ○○ | ○ | 3 | 37.5 |
| Example 34 | 230 | 2.7 | ○ | hot water | ○ | ○ | 2.7 | 41.3 |
| Example 35 | 230 | 3.2 | ○ | hot water | ○ | ○ | 3.7 | 26.5 |
| Example 36 | 230 | 2.9 | ○ | hot water | ○○ | ○ | 3.5 | 29.3 |
| Example 37 | 250 | 3.5 | ○ | hot water | ○ | ○ | 2.6 | 38.5 |
| Comp. Example 9 | 240 | 3.5 | ○○ | hot toluene | ○ | x | 1.2 | 15.2 |
| Comp. Example 10 | 260 | 3.2 | ○○ | hot alkali | ○○ | — | — | — |

Extractability:
○○: Very good. ○: Good.
Feel:
○○: Very good. ○: Good. x: Not good.

TABLE 5

| | Biodegradability (%) | | | |
|---|---|---|---|---|
| | 7 days | 14 days | 21 days | 28 days |
| Example 27 | 98 | 99 | 99 | 99 |
| Comp. Example 9 | 1 | 2 | 2 | 2 |
| Comp. Example 10 | 1 | 2 | 2 | 2 |

EXAMPLE 28 to 37

Knitted fabrics were produced in the same manner as in Example 27, except that PVA shown in Table 1 was used in place of the PVA used in Example 27, and that the fibers were spun at the spinning temperature shown in Table 4 and drawn to the draw ratio also shown in Table 4. The feel and the physical properties of the knitted fabrics are given in Table 4.

COMPARATIVE EXAMPLE 9

A knitted fabric was produced in the same manner as in Example 27, except that polyethylene (Milason FL60 from Mitsui Chemical) but not the PVA used in Example 27 was used herein for preparing the fibers. The knitted fabric was subjected to extraction treatment in toluene at 90° C., but the thus-processed fabric had a rough feel and was not good. In addition, its physical properties were also not good (see Table 4). From the waste water discharged through the extraction treatment, polyethylene was recovered and analyzed for its biodegradability (see Table 5).

COMPARATIVE EXAMPLE 10

A knitted fabric was produced in the same manner as in Example 27, except that polyethylene terephthalate modified with 5 mol % of sulfoisophthalic acid and 4% by weight of Polyethylene glycol (this had an intrinsic viscosity of 0.51, as measured in a mixed solvent of phenol/tetrachloroethane (1/1 by weight) at 30° C.), but not the PVA used in Example 27, was used herein for preparing the fibers. The spinning temperature was 270° C. The knitted fabric was subjected to extraction treatment in NaOH (40 g/liter) at 98° C. In the knitted fabric thus having been subjected to the extraction treatment, not only the modified polyethylene terephthalate but also the polylactic acid dissolved and decomposed in the extractant. As a result, the intended fabric of polylactic acid only could not be obtained herein (see Table 4). From the waste water discharged through the extraction treatment, the modified polyethylene terephthalate was recovered and analyzed for its biodegradability (see Table 5).

EXAMPLE 38

Bi-component fibers were prepared in the same manner as in Example 27, except that 44 mol % ethylene-modified PVA was used in place of the polylactic acid used in Example 27. In this, the shear rate was 2,500 $sec^{-1}$, the draft was 110, and the spinning temperature was 250° C. The fibers were knitted and the knitted fabric was subjected to extraction treatment all in the same manner as in Example 27. The fiber spinnability, the fabric extractability, the feel of the fabric having been subjected to the extraction treatment, and the strength and the elongation of the fibers are given in Table 6.

TABLE 6

| Example | Spinna-bility | Extracta-bility | Feel | Strength (g/d) | Elongation (%) |
|---|---|---|---|---|---|
| Example 38 | OO | OO | OO | 3.9 | 18.9 |
| Example 39 | OO | OO | OO | 4.8 | 32 |
| Example 40 | O | OO | O | 3.8 | 28 |
| Example 41 | O | OO | O | 2.9 | 27 |
| Example 42 | OO | OO | OO | 4.3 | 45 |

Extractability:
OO: Very good. O: Good.
Feel:
OO: Very good. O: Good. x: Not good.

EXAMPLE 39

Bi-component fibers were prepared in the same manner as in Example 27, except that polypropylene (S106LA from Grandpolymer) was used in place of the polylactic acid used in Example 27. In this, the shear rate was 3,300 $sec^{-1}$, the draft was 90, and the spinning temperature was 250° C. The fibers were knitted and the knitted fabric was subjected to extraction treatment all in the same manner as in Example 27 (see Table 6).

EXAMPLE 40

Bi-component fibers were prepared in the same manner as in Example 27, except that polyethylene terephthalate having an intrinsic viscosity of 0.72 (as measured in a mixed solvent of phenol/tetrachloroethane (1/1 by weight) at 30° C.) was used in place of the polylactic acid used in Example 27. In this, the shear rate was 2,300 $sec^{-1}$, the draft was 120, and the spinning temperature was 280° C. The fibers were knitted and the knitted fabric was subjected to extraction treatment all in the same manner as in Example 27 (see Table 6).

EXAMPLE 41

Bi-component fibers were prepared in the same manner as in Example 27, except that polyethylene terephthalate modified with 2.5 mol % of sulfoisophthalic acid and 5 mol % of isophthalic acid (this had an intrinsic viscosity of 0.52, as measured in a mixed solvent of phenol/tetrachloroethane (1/1 by weight) at 30° C.) was used in place of the polylactic acid used in Example 27. In this, the shear rate was 2,300 $sec^{-1}$, the draft was 120, and the spinning temperature was 260° C. The fibers were knitted and the knitted fabric was subjected to extraction treatment all in the same manner as in Example 27 (see Table 6).

EXAMPLE 42

Bi-component fibers were prepared in the same manner as in Example 27, except that nylon 6 (UBE Nylon 6 from Ube Kosan) was used in place of the polylactic acid used in Example 27. In this, the shear rate was 2,500 $sec^{-1}$, the draft was 100, and the spinning temperature was 250° C. The fibers were knitted into a knitted fabric and the fabric was subjected to extraction treatment all in the same manner as in Example 27 (see Table 6).

EXAMPLES 43 to 47

The non-drawn fibers prepared in Examples 27, 38, 40, 41 and 42 were drawn to a draw ratio of 3, using an ordinary roller-on-plate fiber-drawing machine. Thus were produced different types of multi-filaments having an overall profile of 75 deniers/24 filaments. The multi-filaments were woven into a 1/1 plain-woven fabric, in which both the weft and the warp were of the multi-filaments of the same type. The raw fabrics were processed in an aqueous solution containing sodium hydroxide (1 g/liter) and Actinol R-100 (from Matsumoto Yushi) (0.5 g/liter), at 80° C. for 30 minutes. From the thus-processed fabrics, the modified PVA was removed away, and the fabrics all had a soft and good feel. The fabrics of Examples 43 and 45 were dyed with a disperse dye; those of Examples 44 and 47 were with a vat dye; and those of Example 46 were with a cationic dye, all in blue. The fabrics were all dyed well and had good color tone.

EXAMPLES 48 to 52

The modified PVA prepared in Example 27, and the thermoplastic polymer used in any one of Examples 43 to 47 were separately melted and kneaded in different extruders, led into a spinning pack in such a manner that the modified PVA could be on the island side and the other thermoplastic polymer on the sea side, and spun out through a bi-component spinning nozzle while being wound up at a take-up speed of 800 m/min. Thus were produced 1/1 sea/island bi-component fibers in which the number of islands was 16. These were drawn to a draw ratio of 3, using an ordinary roller-on-plate fiber drawing machine. The thus-drawn multi-filaments had an overall profile of 75 deniers/24 filaments. The spinning pack temperature and the drawing temperature were the same as those in Example 27, and Examples 38, 40, 41 and 42. The multi-filaments were knitted into tubular fabrics. These were processed in hot water at 90° C. to remove the PVA component from them. The thus-processed tubular fabrics had a tight but unexperienced new feel. The cross section of each fiber constituting the processed fabrics had a lotus root-like profile, not having the island component.

EXAMPLES 53 to 57

The modified PVA prepared in Example 27, and the thermoplastic polymer used in any one of Examples 38 to 42 were put into one and the same extruder in a ratio of 1/1, and the resulting polymer melt was led into a spinning pack and mixed-spun out through a spinning nozzle while being wound up at a take-up speed of 800 m/min. The mixed-spun fibers were knitted into tubular fabrics and the fabrics were processed to remove the modified PVA from them, in the same manner as in Examples 48 to 52. The fibers constituting the thus-processed fabrics were fibrillated, and the fabrics all had a silky soft feel.

EXAMPLE 58

The drawn fibers prepared in Example 27 (these had a single fiber fineness of 4 deniers) were crimped with a crimper, and cut into short fibers having a length of 51 mm. The short fibers were carded with a roller card, and entangled with a needle punch machine into a non-woven fabric. The fabric was immersed in hot water at 95° C. for 1 hour to remove the modified PVA from it. Thus was obtained a sheet-like fabric of polylactic acid. Its physical properties are given in Table 7.

TABLE 7

| | Extracta-bility | Feel | Weight ($g/m^2$) | Breaking Length (km) |
|---|---|---|---|---|
| Example 58 | OO | OO | 151.3 | 2.6 |
| Comp. Example 11 | OO | x | 148.3 | 1.2 |
| Comp. Example 12 | OO | — | — | — |
| Example 59 | OO | OO | 70.8 | 3.4 |

Extractability:
OO: Very good. O: Good.
Feel:
OO: Very good. O: Good. x: Not good.

COMPARATIVE EXAMPLE 11

A non-woven fabric was produced in the same manner as in Example 58, except that the bi-component fibers prepared in Comparative Example 9 were used herein. The non-woven fabric was subjected to extraction treatment in toluene at 90° C. (see Table 7).

COMPARATIVE EXAMPLE 12

A non-woven fabric was produced in the same manner as in Example 58, except that the bi-component fibers prepared in Comparative Example 10 were used herein. The non-woven fabric was subjected to extraction treatment in NaOH (40 g/liter) at 98° C. In this treatment, not only the modified polyethylene terephthalate but also the polylactic acid dissolved and decomposed in the extractant used, and the intended non-woven fabric of polylactic acid could not be obtained (see Table 7).

EXAMPLE 59

The PVA prepared in Example 27, and polylactic acid having a D-form content of 1% (melting point: 170° C.) were separately melted and kneaded in different extruders, and led into a spinning pack heated at 240° C., through which the modified PVA and the polylactic acid were spun out to give 11-layered bi-component fibers (having a ratio of modified PVA/polylactic acid of ½, and composed of 6 layers of polylactic acid and 5 layers of modified PVA). While being spun, the fibers were wound up at a take-up speed of 800 m/min. The non-drawn fibers were drawn to a draw ratio of 3 in a hot air furnace at 150° C., and cut into short fibers having a length of 5 mm. The short fibers were put into water and dispersed therein by stirring them. The resulting dispersion was sheeted through a 80-mesh, paper-making stainless metal gauze. The resulting sheet was processed with a water stream running at a flow rate of 80 $kg/cm^2$, whereby the bi-component fibers constituting the sheet were untied and entangled. Next, this was immersed in hot water at 95° C. for 1 hour. In the sheet thus processed, the modified PVA was dissolved away. The sheet had high strength, and had a soft and good feel (see Table 7).

EXAMPLE 60

The modified PVA prepared in Example 1 was melted and kneaded at 250° C. in a melt extruder; the resulting polymer melt stream is led into a melt-blow die head, metered with a gear pump, and spun out through a melt-blow nozzle having 0.3 mm $\phi$ orifices aligned in series at a pitch of 0.75 mm, while a hot air stream at 250° C. is applied to the polymer melt stream having been just spun out through the nozzle; and the resulting polymer fibers are collected on a sheeting conveyor to form thereon a melt-blown non-woven fabric having a weight of 50 $g/m^2$. In this process, the unit polymer delivery through the nozzle was 0.2 g/min/orifice, the hot air flow rate was 0.15 $Nm^3$/min/cm width, and the distance between the nozzle and the sheeting conveyor was 15 cm.

Just below the nozzle of the melt-blow system, disposed was a secondary air-blow device via which an air stream at 15° C. was applied to the melt-blown fiber stream at a flow rate of 1 $m^3$/min/cm width.

The melt-blown non-woven fabric thus produced herein had a fiber diameter of 9.6 $\mu$m and a degree of air permeability of 140 $cc/cm^2$/sec. When put into cold water at 5° C., it dissolved therein and lost its original shape. When put into hot water at 50° C., it also dissolved therein and lost its original shape.

The condition of the blown fibers, the condition of the non-woven fabric, the degradability of the non-woven fabric in hot water at 98° C., and the total evaluation of the non-woven fabric are given in Table 8.

The physical properties of the non-woven fabric are given in Table 9.

TABLE 8

| | Conditions for Producing Non-Woven Fabric | | | Evaluation | | | |
|---|---|---|---|---|---|---|---|
| | Blowing Temperature (° C.) | Flow Rate of Primary Air Blow ($Nm^3$/min/cm) | Die-Collector Distance (cm) | Condition of Blown Fibers | Condition of Non-Woven Fabric | Degradability of Non-Woven Fabric (in water at 98° C.) | Total Evaluation |
| Example 60 | 250 | 0.15 | 15 | very good | very good | dissolved | very good |
| Example 61 | 230 | 0.15 | 20 | very good | good | dissolved | good |
| Example 62 | 250 | 0.15 | 15 | Good | good | dissolved | good |
| Example 63 | 230 | 0.1 | 20 | Good | good | dissolved | good |
| Example 64 | 250 | 0.15 | 15 | very good | good | dissolved | very good |
| Example 65 | 240 | 0.15 | 20 | very good | good | dissolved | good |
| Example 66 | 220 | 0.15 | 20 | very good | good | dissolved | good |
| Example 67 | 220 | 0.15 | 20 | Good | good | dissolved | good |
| Example 68 | 210 | 0.1 | 15 | Good | good but somewhat rough | dissolved | good |
| Example 69 | 210 | 0.15 | 30 | Good | good but some webs glued | dissolved | good |
| Example 70 | 260 | 0.1 | 15 | Good | good | dissolved | good |

TABLE 8-continued

| | Conditions for Producing Non-Woven Fabric | | | Evaluation | | | |
|---|---|---|---|---|---|---|---|
| | Blowing Temperature (° C.) | Flow Rate of Primary Air Blow ($Nm^3$/min/cm) | Die-Collector Distance (cm) | Condition of Blown Fibers | Condition of Non-Woven Fabric | Degradability of Non-Woven Fabric (in water at 98° C.) | Total Evaluation |
| Example 71 | 210 | 0.15 | 20 | Good | good | dissolved | good |
| Example 72 | 230 | 0.08 | 20 | Good | good but somewhat rough | dissolved | good |
| Comparative Example 13 | 260 | 0.15 | 15 | not good | melt viscosity of polymer melt too high, forming non-woven fabric impossible | — | not good |
| Comparative Example 14 | 190 | 0.15 | 15 | not good | many webs glued | — | not good |
| Comparative Example 15 | 250 | 0.15 | 15 | not good | resinous grains dispersed in a short time (within about 5 minutes) | — | not good |
| Comparative Example 16 | 250 | 0.15 | 15 | not good | polymer pyrolyzed, stable spinning impossible | — | not good |
| Comparative Example 17 | 260 | 0.15 | 15 | not good | many shots in a short time (within about 5 minutes) | — | not good |

EXAMPLES 61 to 72

PVA melt-blown non-woven fabrics were produced in the same manner as in Example 60, except that PVA shown in Table 1 was used in place of the PVA of Example 1 and that the fiber blowing temperature was varied as in Table 8. The condition of the blown fibers, the condition of the non-woven fabrics, the degradability of the non-woven fabrics, and the total evaluation of the non-woven fabrics are given in Table 8.

EXAMPLE 73

The PVA melt-blown non-woven fabric prepared in Example 60 was embossed under heat and pressure between a metallic gravure roll having a rounding embossing area ratio of 20% and a metallic flat roll, thereby making it into an embossed non-woven fabric. In the process, both the gravure roll and the flat roll had a surface temperature of 100° C., the linear pressure was 35 kg/cm, and the linear velocity was 5 m/min.

The physical properties of the non-woven fabric are given in Table 9. The strength of the embossed non-woven fabric increased. This is because the fibers constituting the embossed non-woven fabric would be fixed together more tightly and the fiber dropping frequency would be reduced.

EXAMPLES 74 to 78

One surface of the PVA melt-blown non-woven fabric prepared in Example 60 was kept in contact with a metallic flat roll rotating at a surface velocity of 5 m/min, and then the other surface thereof was kept in contact with the same roll under the same condition as previously. In that manner, the fabric was subjected to heat treatment. For the heat treatment, one and the other surfaces of the fabric were kept in contact with the running roll for about 8 seconds each.

To clarify the change in the degradability of the fabric in water that may be caused by the temperature change for the heat-treatment, the heat-treatment temperature for the fabric was varied in some points, and the fabric having been undergone the heat treatment at different temperatures was sampled. The structure, the physical properties and the degradability in water of the samples were analyzed, and the data obtained are given in Table 9 and Table 10. Regarding the degradability in water, the samples of the heat-treated fabric were immersed in hot water at 50° C., and their weight retentiveness and outward appearance were also analyzed. The data obtained are given in Table 10.

The samples of the heat-treated fabric all swelled in water, but those for which the heat treatment was higher had an increased degree of weight retentiveness. Specifically, the samples having been heat-treated at a high temperature of 180° C. or 200° C. had a degree of weight retentiveness of 99% or higher, and their outward appearance changed little. On the other hand, the samples of the heat-treated fabric of Examples 74 to 76 swelled well in hot water at 50° C., and their outward appearance became filmy as the fibers constituting the fabric were degraded and lost their original appearance.

The sample of the heat-treated, non-woven fabric of Example 74 still had a degree of weight retentiveness of 31%, after having been immersed in hot water at 50° C. However, it swelled much, and the fibers constituting it lost their original appearance almost completely.

TABLE 9

| | Embossing Temp. (° C.) | Heat Treatment Temp. (° C.) | Heat Treatment Number of Times | Weight (g/m²) | Thickness (mm) | Strength at Break MD × CD (kg/5 cm) | Elongation at Break MD × CD (%) | Tear Strength MD × CD (g) | Air Permeability (cc/cm²/sec) |
|---|---|---|---|---|---|---|---|---|---|
| Example 60 | — | — | — | 49.5 | 0.475 | 0.26 × 0.52 | 12 × 83 | — × — | 140 |
| Example 73 | 100 | — | — | 53.2 | 0.461 | 2.66 × 1.78 | 89 × 100 | 660 × 520 | 145 |
| Example 74 | — | 80 | 1 | 48.4 | 0.462 | 0.22 × 0.48 | 5 × 81 | — × — | 147 |
| Example 75 | — | 100 | 1 | 48 | 0.454 | 0.24 × 0.52 | 4 × 92 | — × — | 151 |
| Example 76 | — | 140 | 1 | 47 | 0.448 | 0.30 × 0.50 | 5 × 84 | — × — | 153 |
| Example 77 | — | 180 | 1 | 46.2 | 0.461 | 0.39 × 0.44 | 5 × 66 | — × — | 162 |
| Example 78 | — | 200 | 1 | 44.4 | 0.441 | 0.76 × 0.58 | 5 × 52 | — × — | 169 |
| Example 79 | — | 200 | 5 | 44.7 | 0.437 | 0.74 × 0.48 | 6 × 43 | — × — | 158 |
| Example 80 | 120 | 180 | 1 | 44.9 | 0.422 | 1.59 × 1.16 | 40 × 60 | 280 × 250 | 125 |
| Example 81 | 120 | 200 | 1 | 45.3 | 0.462 | 1.59 × 1.00 | 26 × 45 | 240 × 270 | 124 |

TABLE 10

| | Degradability in Water 5° C. | Degradability in Water 98° C. | After immersed in 50° C. water: Weight Retentiveness (%) | After immersed in 50° C. water: Outward Appearance |
|---|---|---|---|---|
| Example 60 | dissolved | dissolved | 0 | filmy |
| Example 74 | swelled | dissolved | 31 | filmy |
| Example 75 | swelled | dissolved | 30 | filmy |
| Example 76 | swelled | dissolved | 41 | filmy |
| Example 77 | swelled | dissolved | 99 | no change |
| Example 78 | swelled | dissolved | 100 | no change |
| Example 79 | swelled | dissolved | 100 | no change |
| Example 80 | swelled | dissolved | 100 | no change |
| Example 81 | swelled | dissolved | 100 | no change |

EXAMPLE 79

This is to demonstrate the effect of prolonged heat treatment. Ten heat-treatment rolls were combined in series, and used for processing the non-woven fabric in the same manner as in Example 78. In this, however, one and the other surfaces of the fabric were processed with the series of the thus-combined, ten heat-treatment rolls, for a total of five times for 8 seconds each. The appearance, the physical properties and the degradability in water of the thus-processed fabric are given in Table 9 and Table 10.

EXAMPLE 80

This is to enhance the strength of the non-woven fabric swollen in water. The PVA melt-blown non-woven fabric having been heat-treated in Example 77 was embossed under heat and pressure between a metallic gravure roll having a rounding embossing area ratio of 20% and a metallic flat roll. In the latter step, both the gravure roll and the flat roll had a surface temperature of 120° C., the contact pressure was 35 kg/cm, and the linear velocity was 5 m/min.

EXAMPLE 81

The PVA melt-blown non-woven fabric was first heat-treated in the same manner as in Example 78, and then embossed in the same manner as in Example 80.

The non-woven fabrics having been processed in these Examples 79 to 81 were analyzed for their appearance, physical properties, degradability in water, weight retentiveness after immersion in hot water at 50° C. and outward appearance. The data obtained are given in Table 9 and Table 10.

The strength and the elongation of the embossed, non-woven fabrics of Examples 80 and 81 were higher than those of the non-embossed ones.

COMPARATIVE EXAMPLES 13 and 14

PVA melt-blown non-woven fabrics were produced in the same manner as in Example 60, except that the PVA of Comparative Examples 1 and 2 shown in Table 1 were used herein in place of the PVA used in Example 60 and that the PVA fabrics were blown at the blowing temperature indicated in Table 8. The fiber spinnability, the condition of the non-woven fabrics obtained, the degradability of the non-woven fabrics in water, and the total evaluation of the non-woven fabrics are given in Table 8.

In Comparative Example 13, the blowing temperature of 260° C. is near to the melting point of the polymer PVA and the melt viscosity of the polymer melt was too high at that temperature. In this, therefore, the blowing temperature was elevated to 270° C. At the elevated temperature, the apparent melt viscosity of the polymer melt decreased, but the polymer decomposed and gelled. In that condition, the fiber spinnability was worse.

In Comparative Example 14, the non-woven fabric formed glued with the collector net and could not be wound up. This will be because the crystallinity of the polymer PVA would be lowered.

COMPARATIVE EXAMPLE 15

Producing a PVA non-woven fabric was tried in the same manner as in Example 60. In this, however, PVA to be spun was, after having been washed four times with methanol, further washed three times with a mixed solution of methanol/water=90/10 to thereby reduce the sodium ion content of the polymer PVA to 0.0001 parts by weight, and the polymer was spun into fibers. A large number of resinous grains dispersed on the entire surface of the non-woven fabric formed from the fibers, and the fabric was difficult to wind up. The polymer melt being spun would have gelled as its melt viscosity increased.

COMPARATIVE EXAMPLE 16

Melt-blowing PVA into fibers was tried in the same manner as in Example 60. In this, however, the polymer PVA to be spun was not washed with methanol so that its sodium content could be 1.4 parts by weight. While being spun, the polymer pyrolyzed, and its melt could not be stably blown into fibers.

COMPARATIVE EXAMPLE 17

A non-woven fabric of ultra-thin PVA fibers was produced in the same manner as in Example 60, except that the PVA of Comparative Example 5 shown in Table 1 was used in place of the PVA used in Example 60 and that the blowing temperature was changed to that indicated in Table 8. The fiber spinnability and the properties of the woven-fabric produced are given in Table 8.

EXAMPLE 82

PVA prepared in Example 1 was melted and kneaded in a melt extruder at 240° C., and the resulting polymer melt stream was led into a spinning head, and spun out through a spinneret with 24 orifices each having a diameter of 0.25 mm. Being cooled with cold air at 20° C., the spun fibers were led into a circular suction blasting device, in which the fibers were thinned under suction while being taken up at a speed of substantially 3500 m/min. The resulting opend filaments were collected and deposited on a moving collector conveyor device to form thereon long-fiber webs. The resulting webs were passed through an embossing roll heated at 200° C. and a flat roll, under a linear pressure of 20 kg/cm, so as to be sheeted into a non-woven fabric while being embossed under heat and pressure. Thus was obtained an embossed, long-fiber non-woven fabric having a weight of 30 g/m$^2$, in which the long fibers had a single fiber fineness of 4 deniers.

When put into hot water at 65° C., the non-woven fabric dissolved therein and lost its original appearance.

While the invention has been described in detail and with reference to specific embodiments thereof, it will be apparent to one skilled in the art that various changes and modifications can be made therein without departing from the spirit and scope thereof.

All publications cited herein are incorporated herein by reference.

This application is based on Japanese Patent Application Serial No. 357120, filed on Dec. 16, 1999; 357121/1998, filed on Dec. 16, 1999; 367113/1998, filed on Dec. 24, 1998; and 45745/1999, filed on Apr. 28, 1999, each of which is incorporated herein by reference in its entirety.

What is claimed is:

1. A thermoplastic polyvinyl alcohol fiber which comprises, as at least one component, a water-soluble polyvinyl alcohol, wherein the water-soluble polyvinyl alcohol contains from 0.1 to 25 mol % of C1–4 α-olefin units and/or vinyl ether units, has a molar fraction, based on vinyl alcohol units, of a hydroxyl group of vinyl alcohol unit located at the center of 3 successive vinyl alcohol unit chain in terms of triad expression of from 70 to 99.9 mol %, has a carboxylic acid and lactone ring content of from 0.02 to 0.15 mol %, and has a melting point (Tm) falling between 160° C. and 230° C., and contains an alkali metal ion in an amount in terms of sodium ion of 0.0003 to 1 part by weight based on 100 parts by weight of the polyvinyl alcohol.

2. The thermoplastic polyvinyl alcohol fiber as claimed in claim 1, which is a multi-component fiber comprising the alkali metal ion-containing, water-soluble polyvinyl alcohol and at least one other thermoplastic polymer having a melting point of not higher than 270° C.

3. The thermoplastic polyvinyl alcohol fiber as claimed in claim 1, wherein the polyvinyl alcohol is a modified PVA having an ethylene unit content of from 4 to 15 mol %.

4. The thermoplastic polyvinyl alcohol fiber as claimed in claim 3, wherein the polyvinyl alcohol contains a plasticizer.

5. The thermoplastic polyvinyl alcohol fiber as claimed in claim 4, wherein the plasticizer is a polyalcohol derivative.

6. The thermoplastic polyvinyl alcohol fiber as claimed in claim 5, wherein the polyalcohol derivative is a sorbitol-alkylene oxide adduct.

7. A method for producing thermoplastic polyvinyl alcohol fibers, which comprises melt-spinning a water-soluble polyvinyl alcohol containing from 0.1 to 25 mol % of C1–4 α-olefin units and/or vinyl ether units, having a molar fraction, based on vinyl alcohol units, of a hydroxyl group of vinyl alcohol unit located at the center of 3 successive vinyl alcohol unit chain in terms of triad expression of from 70 to 99.9 mol %, having a carboxylic acid and lactone ring content of from 0.02 to 0.15 mol %, has a melting point (Tm) falling between 160° C. and 230° C., and containing an alkali metal ion in an amount in terms of sodium ion of 0.0003 to 1 part by weight based on 100 parts by weight of the polyvinyl alcohol, at a spinneret temperature falling between Tm and Tm+80° C., at a shear rate (γ) of from 1,000 to 25,000 sec$^{-1}$, and at a draft of from 10 to 500.

8. A fibrous structure comprising, as at least one component, the thermoplastic polyvinyl alcohol fibers of claim 1.

9. A fibrous structure comprising, as at least one component, the thermoplastic polyvinyl alcohol fibers of claim 2.

10. The fibrous structure as claimed in claim 8, comprising said thermoplastic polyvinyl alcohol fibers and other fibers which are insoluble in water or of which the solubility in water is lower than that of said polyvinyl alcohol fibers.

11. The fibrous structure as claimed in claim 9, comprising said thermoplastic polyvinyl alcohol fibers and other fibers which are insoluble in water or of which the solubility in water is lower than that of said polyvinyl alcohol fibers.

12. The fibrous structure as claimed in claim 8, which is in the form of yarns, woven fabrics or knitted fabrics.

13. The fibrous structure as claimed in claim 9, which is in the form of yarns, woven fabrics or knitted fabrics.

14. A method for producing a fibrous product, which comprises processing the fibrous structure of claim 10 with water to thereby dissolve and remove the polyvinyl alcohol constituting the fibers.

15. A method for producing a fibrous product, which comprises processing the fibrous structure of claim 11 with water to thereby dissolve and remove the polyvinyl alcohol constituting the fibers.

16. A non-woven fabric which is comprised of fibers comprising, as at least one component, a modified polyvinyl alcohol containing from 0.1 to 25 mol % of C1–4 α-olefin units and/or vinyl ether units, having a molar fraction, based on vinyl alcohol units, of a hydroxyl group of vinyl alcohol unit located at the center of 3 successive vinyl alcohol unit chain in terms of triad expression of from 66 to 99.9 mol %, having a carboxylic acid and lactone ring content of from 0.02 to 0.15 mol %, and has a melting point (Tm) falling between 160° C. and 230° C., and which contains an alkali metal ion in an amount in terms of sodium ion of 0.0003 to 1 part by weight based on 100 parts by weight of the polyvinyl alcohol.

17. The non-woven fabric as claimed in claim 16, which is comprised of multi-component fibers comprising the alkali metal ion-containing, modified polyvinyl alcohol and at least one other thermoplastic polymer having a melting point of not higher than 270° C.

18. The non-woven fabric as claimed in claim 16, which is a spun-bonded non-woven fabric.

19. The non-woven fabric as claimed in claim 17, which is a spun-bonded non-woven fabric.

20. The non-woven fabric as claimed in claim 16, which is a melt-blown non-woven fabric.

21. The non-woven fabric as claimed in claim 17, which is a melt-blown non-woven fabric.

22. The non-woven fabric as claimed in claim 16, in which the modified polyvinyl alcohol has an ethylene unit content of from 4 to 15 mol %.

* * * * *

UNITED STATES PATENT AND TRADEMARK OFFICE

CERTIFICATE OF CORRECTION

PATENT NO. : 6,552,123 B1
DATED : April 22, 2003
INVENTOR(S) : Katayama et al.

It is certified that error appears in the above-identified patent and that said Letters Patent is hereby corrected as shown below:

Title page,
Insert Item [30], Foreign Application Priority Data:

-- [30] Foreign Application Priority Data

Dec. 16, 1998 (JP) ..... 10-357120
Dec. 16, 1998 (JP) ..... 10-357121
Dec. 24, 1998 (JP) ..... 10-367113
Feb. 24, 1999 (JP) ..... 11-045745 --

Signed and Sealed this

Twenty-sixth Day of August, 2003

JAMES E. ROGAN
*Director of the United States Patent and Trademark Office*